US008831473B2

(12) United States Patent
Hashimoto et al.

(10) Patent No.: US 8,831,473 B2
(45) Date of Patent: Sep. 9, 2014

(54) PHOTOSENSITIVE UNIT AND IMAGE FORMING APPARATUS

(75) Inventors: Junichi Hashimoto, Toyohashi (JP); Yasushi Okabe, Nagoya (JP); Isao Kishi, Nagoya (JP)

(73) Assignee: Brothter Kogyo Kabushiki Kaisha, Nagoya-shi, Aichi-ken (JP)

( * ) Notice: Subject to any disclaimer, the term of this patent is extended or adjusted under 35 U.S.C. 154(b) by 534 days.

(21) Appl. No.: 12/626,324

(22) Filed: Nov. 25, 2009

(65) Prior Publication Data

US 2010/0135694 A1 Jun. 3, 2010

(30) Foreign Application Priority Data

Nov. 28, 2008 (JP) ..... 2008-304942

(51) Int. Cl.
*G03G 21/16* (2006.01)
*G03G 21/18* (2006.01)

(52) U.S. Cl.
CPC ..... *G03G 21/1853* (2013.01); *G03G 21/1676* (2013.01); *G03G 21/1619* (2013.01); *G03G 21/1647* (2013.01); *G03G 2221/1684* (2013.01); *G03G 21/1671* (2013.01); *G03G 21/1623* (2013.01)
USPC ..... 399/111

(58) Field of Classification Search
USPC ..... 399/111, 113
See application file for complete search history.

(56) References Cited

U.S. PATENT DOCUMENTS 4,470,689 A * 9/1984 Nomura et al. ..... 399/114
6,198,891 B1 * 3/2001 Ishida et al. ..... 399/117
6,708,011 B2 * 3/2004 Nomura et al. ..... 399/110
2007/0025755 A1 * 2/2007 Ishikawa et al. ..... 399/98
2007/0036577 A1 2/2007 Okabe et al.
2007/0077086 A1 4/2007 Takakuwa et al.
2007/0077087 A1 4/2007 Okabe et al.
2008/0025749 A1 * 1/2008 Igarashi ..... 399/92

FOREIGN PATENT DOCUMENTS

JP 2007-072420 3/2007
JP 2007-101635 4/2007
JP 2007-101637 4/2007

OTHER PUBLICATIONS

Merriam Webster's Collegiate Dictionary, 10th Ed., 816 (1998).*
Notification of Reasons for Refusal for corresponding Japanese Application 2008-304942 mailed on Sep. 21, 2010.

* cited by examiner

*Primary Examiner* — David Gray
*Assistant Examiner* — Sevan A Aydin
(74) *Attorney, Agent, or Firm* — Banner & Witcoff, Ltd.

(57) ABSTRACT

A photosensitive unit is provided. The photosensitive unit includes a frame, plural photosensitive drums which are held by the frame, plural cartridges detachably mounted in the frame. Each cartridge includes a developing roller for supplying developer to the corresponding photosensitive drum, a supply roller, and a casing having a first casing portion supporting the developing roller and the supply roller and including a first wall, and a second casing portion storing developer and including a second wall connected to the first wall through a first stepped portion. The frame includes plural beam members which are provided between a pair of side parts. Each beam member includes a third wall which opposes the first wall with a distance therebetween, and a fourth wall which opposes the second wall with a distance therebetween in a state where a cartridge is mounted in the frame.

13 Claims, 10 Drawing Sheets

PHOTOSENSITIVE UNIT AND IMAGE FORMING APPARATUS

CROSS-REFERENCE TO RELATED APPLICATION

This application claims priority from Japanese Patent Application No. 2008-304942, filed on Nov. 28, 2008, the entire subject matter of which is incorporated herein by reference.

TECHNICAL FIELD

Aspects of the preset invention relate to an image forming apparatus such as a laser printer, and a photosensitive unit mounted in the image forming apparatus.

BACKGROUND

A color laser printer including a plurality of photosensitive drums on which electrostatic latent images are formed, and which are provided in parallel with each other and arranged in a predetermined direction is known as an image forming apparatus.

The color laser printer includes a drum unit which holds the photosensitive drums as a single main body. The developing cartridges are detachably mounted in the drum unit. Each of the developing cartridges includes a developing roller, and the developing roller develops an electrostatic latent image which is formed on a corresponding one of the photosensitive drums by supplying toner.

In the drum unit, the plurality of developing cartridges are provided in parallel with each other and arranged in a predetermined direction in a limited space, similarly to the plurality of photosensitive drums.

Since the reduction in size of the color laser printer is desired, the size of the drum unit as a component of the color laser printer needs to be reduced in order to reduce the size of the entire color laser printer.

SUMMARY

It is an aspect of the present invention to provide a photosensitive unit which can be reduced in size in the structure in which a plurality of cartridges are mounted on a frame to be in parallel with each other, and an image forming apparatus including the photosensitive unit.

According to an exemplary embodiment of the present invention, there is provided a photosensitive unit comprising: a frame; a plurality of photosensitive drums which are held by the frame to be in parallel with each other and arranged in a predetermined direction, and on which electrostatic images are formed, respectively; a plurality of chargers which are provided so as to oppose the photosensitive drums, respectively, and charge the corresponding photosensitive drums, respectively; and a plurality of cartridges which are detachably mounted in the frame. Each of the cartridges includes: a developing roller configured to develop an electrostatic latent image by supplying developer to the corresponding photosensitive drum; a supply roller supplying developer to the developing roller; and a casing. The casing includes: a first casing portion which rotatably supports the developing roller and the supply roller, and includes a first wall opposing the developing roller and the supply roller; a second casing portion which stores developer, and includes a second wall; and a first stepped portion which connects the first casing portion and the second casing portion such that the first wall protrudes further than the second wall. The frame includes: a pair of side parts including a first side part and a second side part, the first side part and the second side part which are provided on both sides of the photosensitive drums in a longitudinal direction of the photosensitive drums, and rotatably support the photosensitive drums; a plurality of beam members which are provided between the first and second side parts, and hold the chargers, respectively; and an opening formed at an opposite side of the photosensitive drums in a direction orthogonal to the predetermined direction and the longitudinal direction, and through which the cartridges are detachably mounted in the frame. Each of the first and second side parts includes a plurality of guide grooves, each of which extends from the opening toward a downstream side in a mounting direction, along which the cartridge is mounted in the frame, each of the guide grooves being to guide the developing roller of the cartridge to be mounted, toward the corresponding photosensitive drum. Each of the guide grooves includes at least a first portion which is provided at a downstream end in the mounting direction and extends toward a rotation center of the corresponding photosensitive drum as directing to the downstream side in the mounting direction; and a second portion which is provided at an upstream side in the mounting direction and extends from the opening in a direction intersecting an extending direction of the first portion, toward the downstream side in the mounting direction. Each of the beam members includes: a third wall which, in a state where the corresponding cartridge is mounted in the frame, opposes the first wall of the cartridge with a first distance therebetween; a fourth wall which, in a state where the corresponding cartridge is mounted in the frame, opposes the second wall of the cartridge with a second distance therebetween; and a second stepped portion which connects the third wall and the fourth wall such that, in the corresponding cartridge is mounted in the frame, the fourth wall protrudes further toward the cartridge than the third wall.

According to another exemplary embodiment of the present invention, there is provided an image forming apparatus comprising the above-described photosensitive unit.

BRIEF DESCRIPTION OF THE DRAWINGS

The above and other aspects of the present invention will become more apparent and more readily appreciated from the following description of exemplary embodiments of the present invention taken in conjunction with the attached drawings, in which.

DETAILED DESCRIPTION

1. Printer

Figure 1:
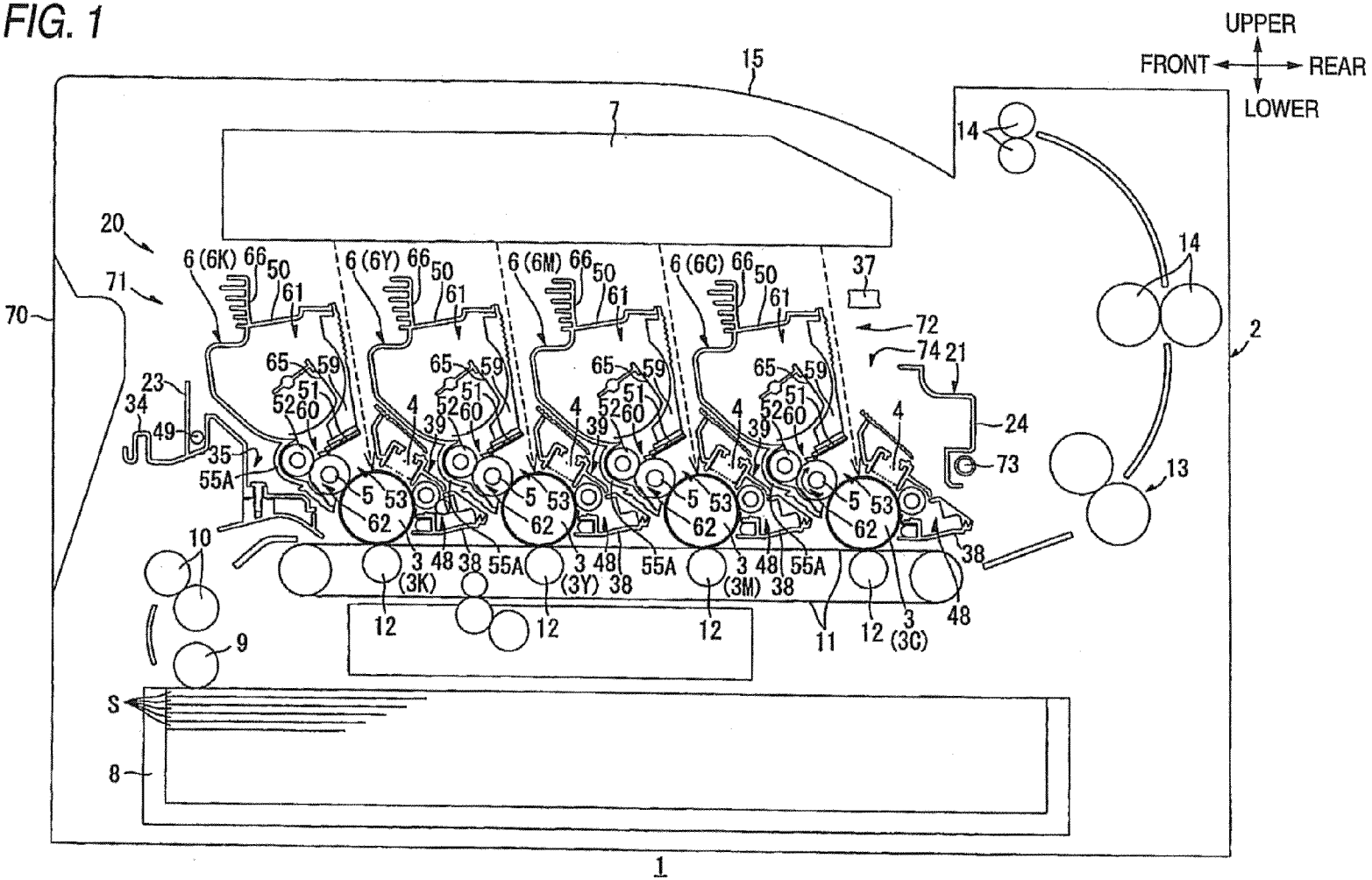
FIG. 1 is a side cross-sectional view of a printer as an example of an image forming apparatus according to an embodiment of the present invention.

Embodiments of the present invention will be described with reference to FIGS. 1 to 9B. A printer 1 is shown in FIG. 1 as an example of an image forming apparatus according to an embodiment of the preset invention. For ease of discussion, in the following description, directions are defined as viewed from a user who operates the printer 1. The top or upper side, the bottom or lower side, the left or left side, the right or right side, the front or front side, and the rear or rear side of the printer 1 are identified as indicated by the arrows in drawings. Further, herein the left-right direction is also referred to as a width direction, and the upper-lower direction is also referred to as a vertical direction. The left-right direction and the front-rear direction are also referred to as a horizontal direction. With regard to various individual components of the printer 1, sides of the individual components are similarly identified based on the arranged/attached position of the components on/in the printer 1.

The printer 1 is a color printer. As shown in FIG. 1, the printer 1 includes a main body casing 2 which has substantially the shape of a box extending in the front-back direction. A plurality of, e.g. four, photosensitive drums 3 are provided to be in parallel with each other and arranged in the front-back direction in the main body casing 2 in a rotatable state. In this state, each of the photosensitive drums 3 extends in the width direction. A scorotron-type charger 4 and a developing roller 5 are provided so as to oppose each of the photosensitive drums 3.

Further, a developing cartridge 6 (as an example of a cartridge) which holds a developing roller 5 and stores toner (as an example of developer) is provided adjacent to each of the photosensitive drums 3. The number of the developing cartridges 6 is four same as that of the photosensitive drums 3. Each of the developing cartridges 6 is detachably mounted in the main body casing 2. In each of the developing cartridges 6, toner is carried on the surface (outer peripheral surface) of the developing roller 5.

At the time of image formation, the surfaces of the respective photosensitive drums 3 are uniformly charged with electricity by the chargers 4 and then are exposed to laser beams (see broken line arrows in FIG. 1) which are emitted from a scanner unit 7 provided at an upper portion of the main body casing 2. Accordingly, an electrostatic latent image based on image data is formed on the surface of each of the photosensitive drums 3. The electrostatic latent image of each of the photosensitive drums 3 is developed into a visible, toner image by the toner which is carried on the surface of the developing roller 5 corresponding to each of the photosensitive drums 3. Accordingly, the toner image is formed on the surface of each of the photosensitive drums 3. That is, the developing roller 5 supplies toner to the corresponding photosensitive drum 3 and develops the electrostatic latent image into the toner image. Here, since the color of the toner stored in each of the developing cartridges 6 varies, the color of the toner image of each of the photosensitive drums 3 varies.

In the following description, four photosensitive drums 3 may be discriminated as a photosensitive drum 3K (black), a photosensitive drum 3Y (yellow), a photosensitive drum 3M (magenta), and a photosensitive drum 3C (cyan) in accordance with the colors of the toner images formed on the respective photosensitive drums 3. These photosensitive drums 3 are provided from the front side in the order of the photosensitive drum 3K, the photosensitive drum 3Y, the photosensitive drum 3M, and the photosensitive drum 3C. Similarly, four developing cartridges 6 may be discriminated as a developing cartridge 6K (black), a developing cartridge 6Y (yellow), a developing cartridge 6M (magenta), and a developing cartridge 6C (cyan) in accordance with the respective colors.

Sheets S (as an example of recording media) are stored in a sheet feed cassette 8, which is provided at a bottom of the main body casing 2, so as to be stacked in an up-down direction. At the time of image formation, the uppermost sheet S of the sheets S, which are stored in the sheet feed cassette 8, is fed forward by a sheet feed roller 9 which is provided so as to oppose the front end portion of the sheet feed cassette 8 from above. The fed sheet S is conveyed upward while the direction of the sheet is changed from the front direction to the rear direction.

The conveyed sheet S enters between a pair of registration rollers 10. The pair of registration rollers 10 sends the sheet S to a rear-side transport belt 11 at a predetermined timing.

The transport belt 11 is an endless belt, and four transfer rollers 12 are provided inside the transport belt 11. The four transfer rollers 12 are provided in parallel with each other and arranged in the front-back direction, and each of the transfer rollers 12 opposes the corresponding photosensitive drum 3 from below with the upper portion of the transport belt 11 interposed therebetween.

The sheet S is sent from the pair of registration rollers 10 onto the upper portion of the transport belt 11. The transport belt 11 is rotated in a clockwise direction in FIG. 1, so that the sheet S sent onto the upper portion of the transport belt is transported to the rear side. The toner images, which are formed on the surfaces of the respective photosensitive drums 3, are transferred to the sheet 5, which is transported by the transport belt 11, by a transfer bias applied to the transfer rollers 12 and are sequentially superimposed. Since the color of the toner image of each of the photosensitive drums 3 varies according to each of the photosensitive drums 3, toner images corresponding to four colors are superimposed on the sheet 5, so that a color image is formed on the sheet S.

The sheet S on which the color image has been formed is transported to a rear-side fixing unit 13 by the transport belt 11. Here, the toner images of the respective photosensitive drums 3, which have been transferred to the sheet S, are fixed by heat in the fixing unit 13. After that, the sheet S is upwardly transported by transport rollers 14, while the direction of the sheet is changed from the rear direction to the front direction. Then, the sheet is discharged to a sheet discharge tray 15 which is provided at an upper portion of the main body casing 2.

2. Process Unit

The above-mentioned plurality of photosensitive drums 3, chargers 4, and developing cartridges 6 are unitized together with other components to configure a process unit 20 (as an example of a photosensitive unit). The process unit 20 can be installed to or removed from the main body casing 2 in a substantially horizontal direction (front-back direction). The installation and removal of the process unit 20 will be described below.

2. Process Unit (1) Structure of Process Unit

The process unit 20 is divided into a drawer unit 21 (as an example of a frame), and the above-mentioned four developing cartridges 6. The drawer unit 21 holds the photosensitive drums 3 and the chargers 4. Each of the developing cartridges 6 can be mounted in or detached from the drawer unit 21 from above, which will be described below. In other words, the developing cartridge is detachably mounted in the drawer unit 21.

(1-1) Drawer Unit

Figure 2:
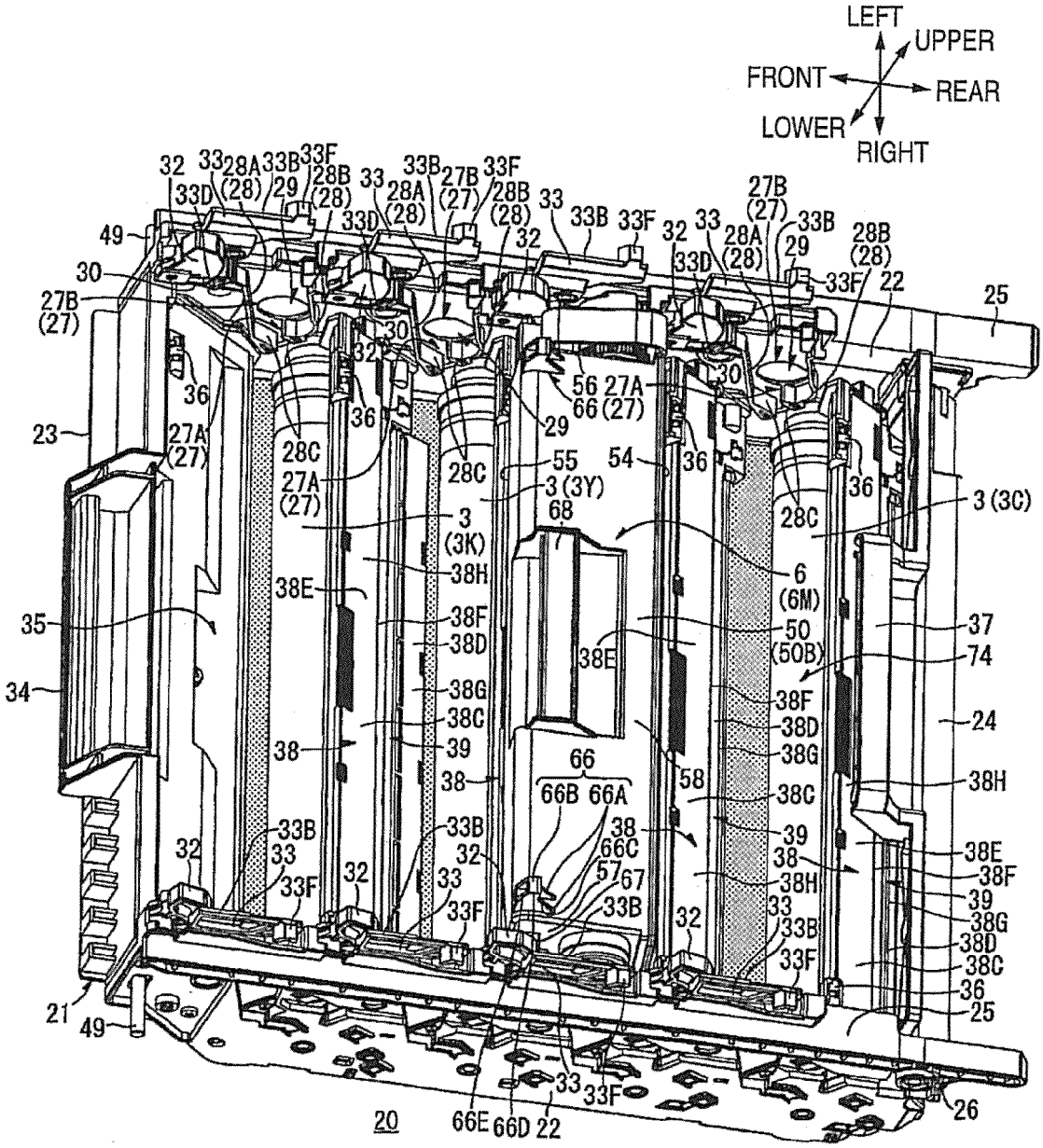
FIG. 2 is a perspective view of a process unit according to the embodiment of the present invention when viewed from a front, top and right side.
Figure 3:
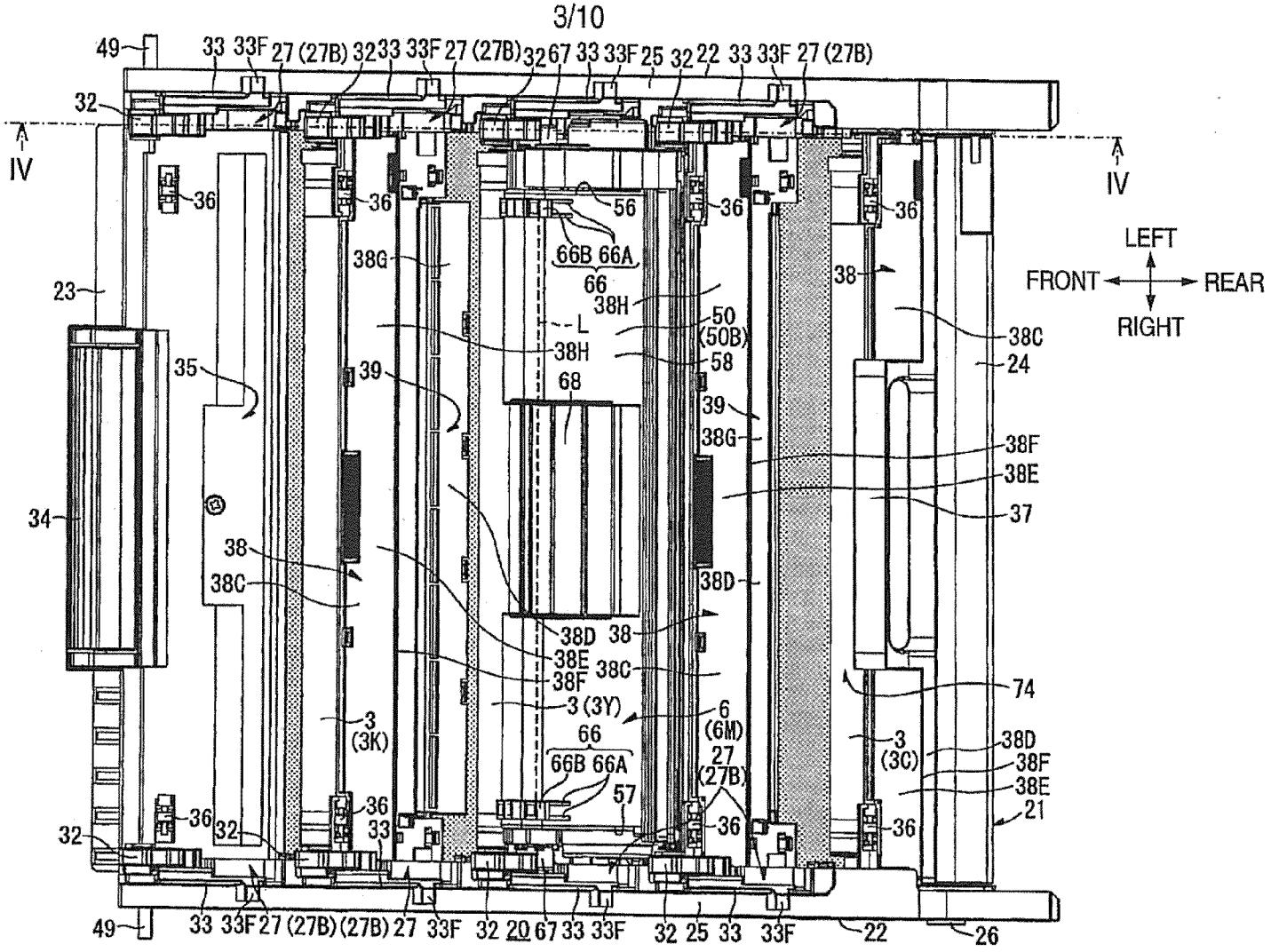
FIG. 3 is a plan view of the process unit according to the embodiment of the present invention.

The drawer unit 21 has a substantially rectangular box shape which is long in the front-back direction when viewed from the upper side (see FIGS. 2 and 3). As shown in FIG. 2, the drawer unit 21 is open at its top and bottom, and the inside of the drawer unit 21 is exposed to the outside through the top and bottom. Here, the open top of the drawer unit 21 provides an opening 74. In FIG. 2, the open bottom of the drawer unit 21 is shown by dots (the same is applied to FIG. 3).

The drawer unit 21 includes a pair of right and left side plates 22 (as an example of side parts) and front and rear beams 23 and 24 which are integrally formed. The side plates 22 are provided so as to oppose each other with a distance therebetween in the width direction. The front beam 23 is provided between the front ends of the pair of side plates 22. The rear beam 24 is provided between the rear ends of the pair of side plates 22.

Each of the side plates 22 extends substantially vertically, and has a substantially rectangular shape which is long in the front-back direction. A guide rail 25 is formed integrally with the upper end edge of each of the side plates 22. The guide rail 25 has the shape of a bar which extends in the front-back direction. The guide rail 25 is connected to the entire upper end edge of the side plate 22 in the front-back direction. In this state, the outer end of the guide rail 25 in the width direction protrudes outward from the side plate 22, and the rear end portion of the guide rail 25 protrudes rearward from the rear end portion of the side plate 22. The upper and lower surfaces of the guide rail 25 are flat in the substantially horizontal direction. A roller 26 is rotatably provided at the lower surface of the rear end portion of the guide rail 25. The rotating shaft of the roller 26 extends in the width direction.

Figure 4:
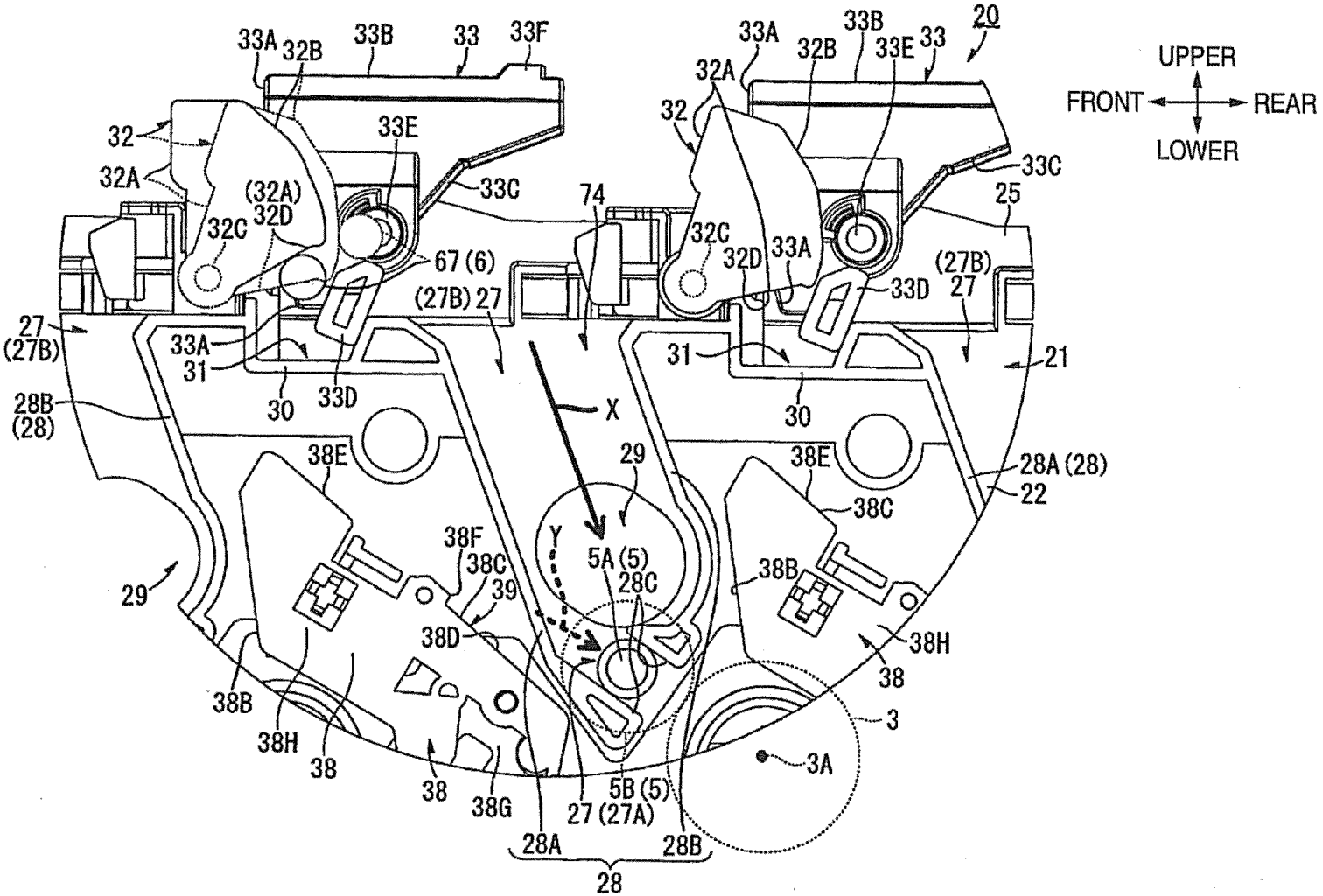
FIG. 4 is a partial view in a cross section taken along a line IV-IV of FIG. 3.

Guide grooves 27 are formed on the inner surface of each of the side plates 22 in the width direction (see the left side plate 22). On each of the side plates 22, four guide grooves 27 are formed at regular intervals in the front-back direction. In FIG. 2, the second guide groove 27 from the rearmost guide groove 27 is not shown on the left side plate 22. As shown in FIG. 4, each of the guide grooves 27 extends from the opening 74 in a direction toward the substantially rear lower side between the upper end edge of the side plate 22 and the substantially middle position of the side plate 22 in the up-down direction. This direction is shown by a thick solid line, hereinafter also referred to as a "first inclination direction X".

Specifically, four sets of a pair of guide ribs 28 are formed at intervals in the front-back direction on the inner surface of each of the side plates 22 in the width direction so as to correspond to the number of the guide grooves 27. Each pair of guide ribs 28 protrudes inward in the width direction so as to define each of the guide grooves 27 while extending in the first inclination direction X (see also FIG. 2).

A rib of each pair of guide ribs 28 which is provided on the front side is referred to as a front rib 28A, and a rib thereof which is provided on the rear side is referred to as a rear rib 28B. An area, which is defined between the front and rear ribs 28A and 28B in the front-back direction, is one guide groove 27. A lower end portion of the front rib 28A is further inclined rearward in comparison with an upper portion of the front rib 28A which is formed above the lower end portion. The substantially lower half of the rear rib 28B swells rearward in an arc shape.

The lower end portion of the front rib 28A opposes the lower end portion of the rear rib 28B from the front lower side with a predetermined distance therebetween, which substantially corresponds to the diameter of a developing roller shaft 5A to be described below. Assuming that surfaces of the lower end portions, which opposes each other, of the respective front and rear ribs 28A and 28B are referred to as opposite surfaces 28C, the opposite surface 28C of the front rib 28A and the opposite surface 28C of the rear rib 28B extend parallel to each other with the predetermined distance therebetween in a direction which is further inclined rearward in comparison with the first inclination direction X. This direction is shown by a thick dashed line, hereinafter also referred to as a "second inclination direction Y".

In other words, each of the guide grooves 27 includes a first portion 27A which extends in the second inclination direction Y and a second portion 27B which extends in the first inclination direction X. The second portion 27B is an upper portion of the guide groove 27 which continues to (or extends from) the opening 74. The first portion 27A continues to (or extends from) the lower end of the second portion 27B and forms the lower end portion of the guide groove 27. Further, since the first and second inclination directions X and Y intersect each other, it is understood that the second portion 27B extends in a direction intersecting the first portion 27A.

Meanwhile, the first portion 27A may not directly continue to the lower end of the second portion 27B, and the guide groove 27 may include a third portion (not shown) for connecting the first portion 27A with the second portion 27B in addition to the first and second portions 27A and 27B.

Further, insertion holes 29 are formed in the left side plate 22. Each insertion hole 29 passes through the side plate 22 in the width direction and is located within the guide groove 27, in the vicinity of the lower end portion of the guide groove 27, in other words, in the vicinity of a portion of the corresponding rear rib 28B which swells rearward in the arc shape.

An extension portion 30 is formed integrally with the upper end edge of the front rib 28A. The extension portion 30 extends forward from the upper end edge of the front rib 28A. A recessed portion 31, which extends downwards, is formed on the upper surface of the extension portion 30. When viewed in the width direction, the front side of the recessed portion 31 is defined by a substantially vertical surface, the lower side of the recessed portion 31 is defined by a substantially horizontal surface, and the rear side of the recessed portion 31 is defined by an inclined surface which extends toward the rear upper side.

Meanwhile, as described above, four sets of the pair of guide ribs 2S are formed on the inner surface of each of the side plates 22 in the width direction (see also FIG. 2). However, in two sets of guide ribs 28 adjacent to each other in the front-back direction, the extension portion 30 connects the upper end edge of the front rib 28A of the rear set of guide ribs 28 with the upper end edge of the rear rib 28B of the front set of guide ribs 28.

Further, a press cam 32 and a separation cam 33 are provided on the inner surface of each of the side plates 22 in the width direction at positions adjacent to the extension portion 30 of the front rib 28A, which corresponds to each of the guide grooves 27, from above. Since four guide grooves 27 are formed on each of the side plates 22, four press cams 32 and four separation cams 33 are provided on each of the side plates (see FIG. 2).

The press cam 32 has a substantially fan-like shape when viewed in the width direction. Referring to the rear press cam 32 in FIG. 4, the outline of the press cam 32 is divided into a pair of planar (substantially planar) portions 32A and a curve surface portion 32B when viewed in the width direction. A distance between the planar portions is increased toward the rear upper side, and the curve surface portion connects the rear upper ends of the respective planar portions 32A and swells in the are shape toward the rear upper side.

The press cam 32 includes a rotating shaft 32C which extends outward in the width direction in the vicinity of a connection portion between the front lower ends of the pair of planar portions 32A. The rotating shaft 32C is supported by the inner surfaces of the corresponding side plates 22 in the width direction. Accordingly, the press cam 32 is rotatable about the rotating shaft 32C. Specifically, the press cam 32 is rotatable between a waiting position which corresponds to the press cam 32 at the rear side in FIG. 4 and a pressing position which corresponds to the press cam 32 at the front side (see a portion shown by a solid line) in FIG. 4. Referring to the front press cam 32 of FIG. 4, the front press cam 32 (see a portion shown by a solid line) is a state where the press cam 32 in the waiting position (see a portion shown by a dotted line) has been rotated toward the front upper side. The press cam 32 is always pushed by a pushing member (not shown) in a direction where the position of the press cam is changed from the pressing position to the waiting position.

The lower planar portion 32A of the pair of planar portions 32A of the press cam 32 is referred to as a pressing surface 32D. While the press cam 32 is pushed in the direction where the position of the press cam is changed from the pressing position to the waiting position as described above, the pressing surface 32D is pushed toward the recessed portion 31 of the corresponding extension portion 30.

The separation cam 33 is adjacent to the corresponding press cam 32 from the rear side and outside in the width direction without coming into contact with the corresponding press cam 32. The separation cam 33 has substantially the shape of a right triangle, which has a right-angled portion at the front upper end thereof, when viewed in the width direction. That is, when viewed in the width direction, the outline of the separation cam 33 is divided into a vertical portion 33A which extends substantially vertically, a horizontal portion 33B which extends substantially horizontally from the upper end of the vertical portion 33A toward the rear side, and an inclined portion 33C which continues to the rear end of the horizontal portion 33B and extends toward the front lower side so as to be connected to the lower end of the vertical portion 33A, in a state shown in FIG. 4. The horizontal portion 33B is positioned above the guide rail 25 which is formed at the upper end edge of the corresponding side plate 22 (see FIG. 2).

A separation portion 33D is formed integrally with the lower end of the inclined portion 33C. The separation portion 33D protrudes from the separation cam 33 to the outside in the width direction, and has a trapezoid shape of which the front portion of the upper end portion is cut out when viewed in the width direction. The position of the separation portion 33D is the same as the position of the press cam 32 in the width direction.

Further, the separation cam 33 includes a rotating shaft 33E, which extends outward in the width direction, above the separation portion 33D which is formed at the inclined portion 33C. The rotating shaft 33E is supported by the inner surfaces of the corresponding side plates 22 in the width direction. Accordingly, the separation cam 33 is rotatable about the rotating shaft 33E. Specifically, the separation cam 33 is rotatable between a waiting position shown in FIG. 4 and a separation position (not shown).

When the separation cam 33 is in the waiting position, the separation portion 33D is fitted to the recessed portion 31 of the corresponding extension portion 30 and is inclined toward the rear upper side along the inclined surface partitioning the rear side of the recessed portion 31. Although not shown, when the separation earn 33 is in the separation position, the separation portion 33D is further deviated upward in comparison with when the separation cam 33 is in the waiting position. A direction where the separation portion 33D is deviated (a direction toward the front upper side) is substantially parallel to the above-mentioned second inclination direction Y (see an arrow shown by a thick dashed line). The separation cam 33 is always pushed by a pushing member (not shown) in a direction where the position of the separation cam is changed from the separation position to the waiting position.

Meanwhile, a protrusion 33F, which protrudes toward the upper side and the outside in the width direction, is formed integrally with the rear end of the horizontal portion 33B of the separation cam 33 (see also FIG. 2).

When the press cam 32 and the separation cam 33 are in the waiting position, referring to the rear press cam 32 and separation cam 33 of FIG. 4, the lower end portion of the curve surface portion 32B of the press cam 32 opposes the front surface of the separation portion 33D of the separation cam 33 from the front side with a small distance therebetween.

As shown in FIG. 2 and described above, the front beam 23 is provided between the front ends of the pair of side plates 22. The front surface of the front beam 23 is a substantially vertical surface, and the entire rear surface thereof is inclined toward the rear lower side. A handle (which is referred to as a front handle 34) is provided in the middle of the front surface of the front beam 23 in the width direction.

A recess 35, which extends toward the front lower side, is formed at a lower portion of the rear surface of the front beam 23. The recess 35 is formed over almost the entire rear surface of the front beam 23 in the width direction. Rollers 36 are rotatably provided above the recess 35 at both ends of the rear surface of the front beam 23 in the width direction. The rotating shaft of the roller 36 extends in the width direction.

The lower end (rear end) of the rear surface of the front beam 23 is adjacent to the lower end of the foremost guide groove 27 of each of the side plates 22 from the front side. A positioning shaft 49, which extends in the width direction, is inserted into the front beam 23, and both ends of the positioning shaft 49 in the width direction pass through the front end portions of the left and right side plates 22 and are exposed to the outside in the width direction.

As described above, the rear beam 24 is provided between the rear ends of the pair of side plates 22. A handle (referred to as a rear handle 37), is provided in the middle of the upper end of the rear beam 24 in the width direction and extends so as to be inclined toward the front upper side.

Further, the above-mentioned four photosensitive drums 3 are provided in parallel with each other and arranged at predetermined intervals in the front-back direction in the area between the front and rear beams 23 and 24 in the front-back direction (the second to last photosensitive drum 3 is not shown in FIG. 2). In this state, each of the photosensitive drums 3 is installed (held) between the pair of side plates 22 on the rear lower side of the lower end of the corresponding guide groove 27 in the front-back direction, and is rotatably supported by the pair of side plates 22 (that is, the drawer unit 21). The rotating shaft of each of the photosensitive drums 3 extends in the width direction. The lower outer peripheral surface of each of the photosensitive drums 3 is exposed to the lower side through the open bottom of the drawer unit 21 (see a portion shown by dots in FIG. 2).

Here, it is understood that the pair of side plates 22 is provided on both sides of each of the photosensitive drums 3 in the width direction since each of the photosensitive drums 3 is installed between the pair of side plates 22. Further, since each of the photosensitive drums 3 is provided on the rear lower side of the lower end of the corresponding guide groove 27 in the front-back direction, the open top (opening 74) of the drawer unit 21 is provided on the opposite side of the four photosensitive drums 3 in the up-down direction (a direction orthogonal to the front-back direction and the width direction).

A beam member 38 is provided so as to oppose each of the photosensitive drums 3 from the rear upper side. That is, the number of the beam members 38 is four corresponding to the photosensitive drums 3, and the beam members 38 are provided in the drawer unit 21 (see FIG. 1). Each of the beam members 38 is provided between the pair of side plate 22.

The beam members 38 will be described below with reference to the foremost beam member 38 of FIG. 5B.

First, the cross-section of each of the beam members 38 has a substantially triangular shape when viewed in the width direction. Specifically, when viewed in the width direction, the outline of each of the beam members 38 is divided into a lower wall 38A which extends substantially horizontally, a front wail 38B which extends upward from the front end of the lower wall 38A, and a rear wall 38C which extends from the upper end of the front wall 38B toward the rear lower side in a direction substantially parallel to the above-mentioned second inclination direction Y (see FIG. 4), and is connected to the rear end of the lower wall 38A. The front wall 38B of each of the beam members 38 opposes the corresponding photosensitive drum 3 from the rear upper side.

The rear wall 38C has a shape where the substantially lower half of the rear wall 38C is recessed in comparison with the substantially upper half thereof by one step. In other words, a recess 39, which extends toward the front lower side, is formed at the substantially lower half of the rear wall 38C. The substantially lower half of the rear wall 38C, which is a portion where the recess 39 is formed, and is referred to as a lower rear wall 38D (as an example of a third wall), is substantially parallel to the substantially upper half thereof, which is a portion where the recess 39 is not formed, and is referred to as a upper rear wall 38E (as an example of a fourth wall). In other words, the upper rear wall 38E is adjacent to the lower rear wall 38D with a stepped portion, which is referred to as a second stepped portion 38F, from above, and further protrudes (is further deviated) toward the rear upper side in comparison with the lower rear wall 38D. Further, in other words, the upper rear wall 38E is connected to the lower rear wall 38D though the second stepped portion 38F.

The above-mentioned rollers 36 are rotatably provided at both ends of the upper rear wall 38E in the width direction (see FIG. 2).

Further, in the following description, the substantially lower half of each of the beam members 38 defined in part by the lower rear wall 38D (recess 39) is referred to as a first portion 38G, and the substantially lower upper thereof defined in part by the upper rear wall 38E (which does not correspond to the recess 39) is referred to as a second portion 38H.

Each of the beam members 38 holds the above-mentioned charger 4 and a cleaning unit 48.

Subsequently, referring to the foremost beam member 38 of FIG. 5B, the charger 4 is held by the second portion 38H. The changer 4 includes a discharge wire 40 and a grid 41. The discharge wire 40 is provided so as to oppose the corresponding photosensitive drum 3 (which is adjacent to the beam member 38 from the front side) with a distance therebetween in the second portion 38H. The grid 41 is provided between the discharge wire 40 and the photosensitive drum 3 and controls the amount of charge which is applied from the discharge wire 40 to the photosensitive drum 3. When viewed in the width direction, the grid 41 has a substantially U shape where a rear upper side is opened, and the discharge wire 40 extends in the width direction in the grid 41. The grid 41 is exposed to the photosensitive drum 3 from the front wall 38B of the beam member 38.

At the time of image formation, a bias is applied to the grid 41 and a high voltage is applied to the discharge wire 40, which causes the corona discharge of the discharge wire 40. As a result, the charger 4 uniformly charges the surface of the photosensitive drum 3 with electricity as described above. Here, a predetermined space (referred to as a flow passage 45) is defined above the charger 4 in the second portion 38H. The flow passage 45 passes through the second portion 38H in the width direction, and communicates with the outside of the drawer unit 21 and the respective chargers 4 (at least discharge wires 40). Accordingly, the flow passage 45 allows air outside the drawer unit 21 to flow so that the air passes through the charger 4.

The cleaning unit 48 is provided in the first portion 38G. The cleaning unit 48 includes a cleaning roller 42, a sub-roller 43, and a scraping member 44. The cleaning roller 42 configures an example of a cleaning member. The cleaning roller 42 is rotatably supported (held) by the first portion 38G while the cleaning roller 42 is provided at the front wall 38B of the beam member 38 so as to oppose the photosensitive drum 3 and comes into contact with the surface of the photosensitive drum 3 from the rear side. The sub-roller 43 is rotatably supported by the first portion 38G while coming into contact with the cleaning roller 42 from the rear lower side. The scraping member 44 is formed of a sponge-like material. The scraping member 44 protrudes forward while being supported by the first portion 38G, and comes into contact with the rear peripheral surface of the sub-roller 43 from the rear side. Further, a predetermined space is defined below the sub-roller 43 and the scraping member 44 in the first portion 38G. The space is referred to as a collecting chamber 46).

In the cleaning unit 48, at the time of image formation, a primary bias is applied to the cleaning roller 42 from a bias supply source (not shown) provided in the main body casing 2 (see FIG. 1), and a secondary bias is also applied to the sub-roller 43 from the bias supply source (not shown).

Here, while a toner image is transferred to the sheet S (see FIG. 1) from the above-mentioned photosensitive drum 3, paper powder or dust may stick to the photosensitive drum 3 from the sheet S. Further, after the toner image is transferred to the sheet S, residual toner may remain on the photosensitive drum 3. Among the foreign materials which remain on the surface of the photosensitive drum 3, such as the paper powder and the residual toner, the residual toner is transferred to the surface of the cleaning roller 42 by the above-mentioned primary bias and caught by the cleaning roller 42. Further, at a time other than the time of image formation, among the foreign materials existing on the surface of the photosensitive drum 3, the paper powder is transferred to the cleaning roller 42 by the primary bias, is transferred to the surface of the sub-roller 43 by a secondary bias (specifically, the difference between the primary bias and the secondary bias), and is then recovered by the sub-roller 43. That is, the sub-roller 43 selects and collects the paper powder from the foreign materials which are caught by the cleaning roller 42. The paper powder, which is collected by the sub-roller 43, is scraped off by the scraping member 44 and then received in the collecting chamber 46.

At the time of the completion of the image formation, a bias, of which direction is opposite to the primary bias, is applied to the cleaning roller 42, and the residual toner caught by the cleaning roller 42 is discharged from the cleaning roller 42 to the photosensitive drum 3 and then collected by the developing roller 5. That is, the printer 1 is a so-called cleanerless printer where the residual toner (waste toner) remaining on the photosensitive drum 3 is collected by the developing roller 5 and the residual toner collection is not performed by a component other than the developing roller 5 (here, the cleaning unit 48).

Further, referring to the three beam members 38 provided on the front side, the sub-roller 43 and the scraping member 44 may be omitted in the cleaning unit 48.

Additionally, each of the beam members 38 holds a charge removing member 47 below the cleaning roller 42. The charge removing member 47 exposes the entire surface of the photosensitive drum 3 where the transfer of the toner image has been completed to light, so as to remove electric charges remaining on the surface of the photosensitive drum 3.

(1-2) Developing Cartridge

Subsequently, the developing cartridge 6 will be described below with reference to FIG. 5B. A state, where the developing cartridge 6 is completely mounted in the drawer unit 21 and the main body casing 2 (see FIGS. 1 and 5B), is used as a reference state in the description of the developing cartridge 6. The position of the developing cartridges 6 in this case is referred to a first position. Further, in the first position, the developing roller 5 comes into contact with the corresponding photosensitive drum 3 in the developing cartridge 6. The position of the developing cartridge 6 in this case is referred to a contact position.

The developing cartridges 6 have the same structure except that the colors of the toner stored in the four developing cartridges 6 are different from each other. Therefore, the developing cartridge 6 will be described with reference to the developing cartridge 6K which is positioned in the front in FIG. 5B.

The developing cartridge 6 mainly includes the above-mentioned developing roller 5, a layer thickness regulating blade 51, and a supply roller 52 in a developing casing 50 (as an example of a casing) which forms the shape of the developing cartridge 6.

The developing casing 50 has the shape of a box which is long in the width direction, and includes an opening 53 at the lower end thereof. The developing casing 50 includes a rear wall 54, a front wall 55, left and right walls 56 and 57, and a top wall 58 (see also FIG. 2). The left and right walls 56 and 57 oppose each other with a distance therebetween in the width direction.

The rear wall 54 extends substantially vertically (precisely, the rear wall 54 is inclined slightly forward), and the front wall 55 extends toward the rear lower side in a direction parallel to the second inclination direction Y shown in FIG. 4. That is, a distance between the rear and front walls 54 and 55 in the front-back direction is decreased toward the lower side. The lower end edge of the front wall 55 extends in the width direction.

The left wall 56 is provided between the left ends of the rear and front wall 54 and 55. The right wall 57 is provided between the right ends of the rear and front wall 54 and 55. Since the distance between the rear and front walls 54 and 55 in the front-back direction is decreased toward the lower side as described above, each of the left and right walls 56 and 57 has a substantially triangular shape which becomes narrow toward the lower side.

Bosses 67, which protrude outward in the width direction, are formed integrally with the outer surfaces of the left and right walls 56 and 57 in the width direction, respectively (see also FIGS. 2 and 3). In FIG. 2, the boss 67 of the right wall 57 is shown. The boss 67 functions as an example of a portion to be pressed, and is formed at the front upper end of the corresponding wall of the left and right walls 56 and 57. As described above, the bosses 67 are formed on both sides of each of the developing cartridges 6 in the width direction (see FIG. 3).

The top wall 58 covers a portion which is surrounded by the upper ends of the rear, front, left, and right walls 54, 55, 56, and 57, from above. Contacted portions 66 are formed integrally with both ends of the front area of the top wall 58. That is, the contacted portions 66 are formed at both ends of the developing cartridge 6 in the width direction (a direction orthogonal to the front-back direction). Further, in each of the developing cartridges 6, the contacted portions 66, which are formed at both ends of the developing cartridge 6 in the width direction, are provided on a straight line L parallel to the width direction (see FIG. 3).

Referring to the right contacted portion 66 of FIG. 2, each of the contacted portions 66 includes two ribs 66A and an installation member 66B which are integrally formed. The two ribs 66A are provided so as to oppose each other with a predetermined distance therebetween in the width direction. The installation member 66B is extended between the upper ends of the two ribs 66A. Each of the ribs 66A has a substantially triangular shape, which becomes narrow toward the upper side, when viewed in the width direction. The outline of each of the ribs 66A is divided into a rear edge 66C, an upper edge 66D, and a front edge 66E, when viewed in the width direction. The rear edge 66C extends toward the front upper side and then extends upward in a substantially vertical direction. The upper edge 66D extends, forward from the upper end of the rear edge 66C. The front edge 66E extends from the front end of the upper edge 66D toward the front lower side and then extends downward in a substantially vertical direction. The installation member 66B is flat in a substantially horizontal direction, and is extended between the upper edges 66D of the two ribs 66A.

Further, a grip 68 is integrally formed in the middle of (area interposed between the left and right contacted portions 66) the top wall 58 in the width direction.

Figure 5A:
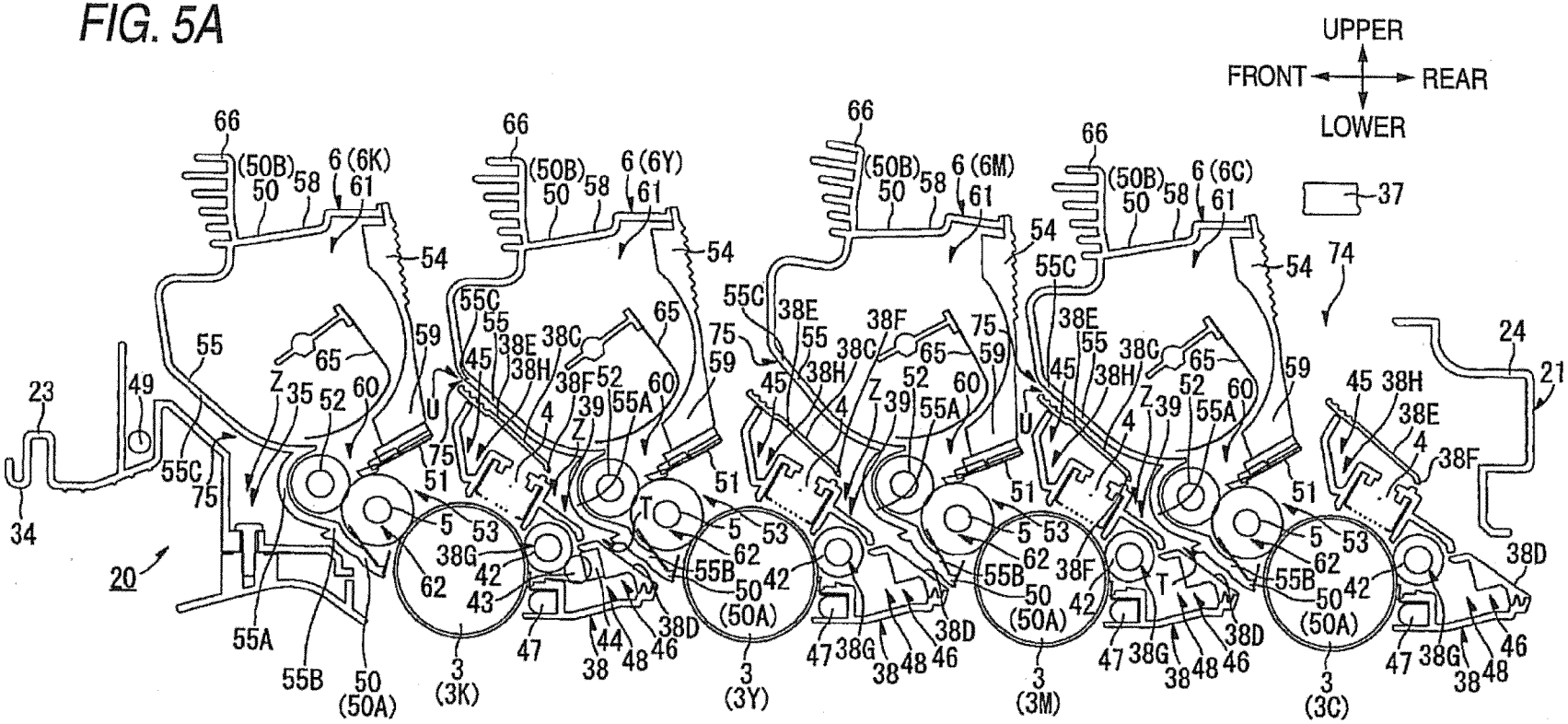
FIG. 5A is a right side cross-sectional view of the process unit, wherein only a second developing cartridge from the rearmost developing cartridge is in a second position, and the other developing cartridges are in a first position.
Figure 5B:
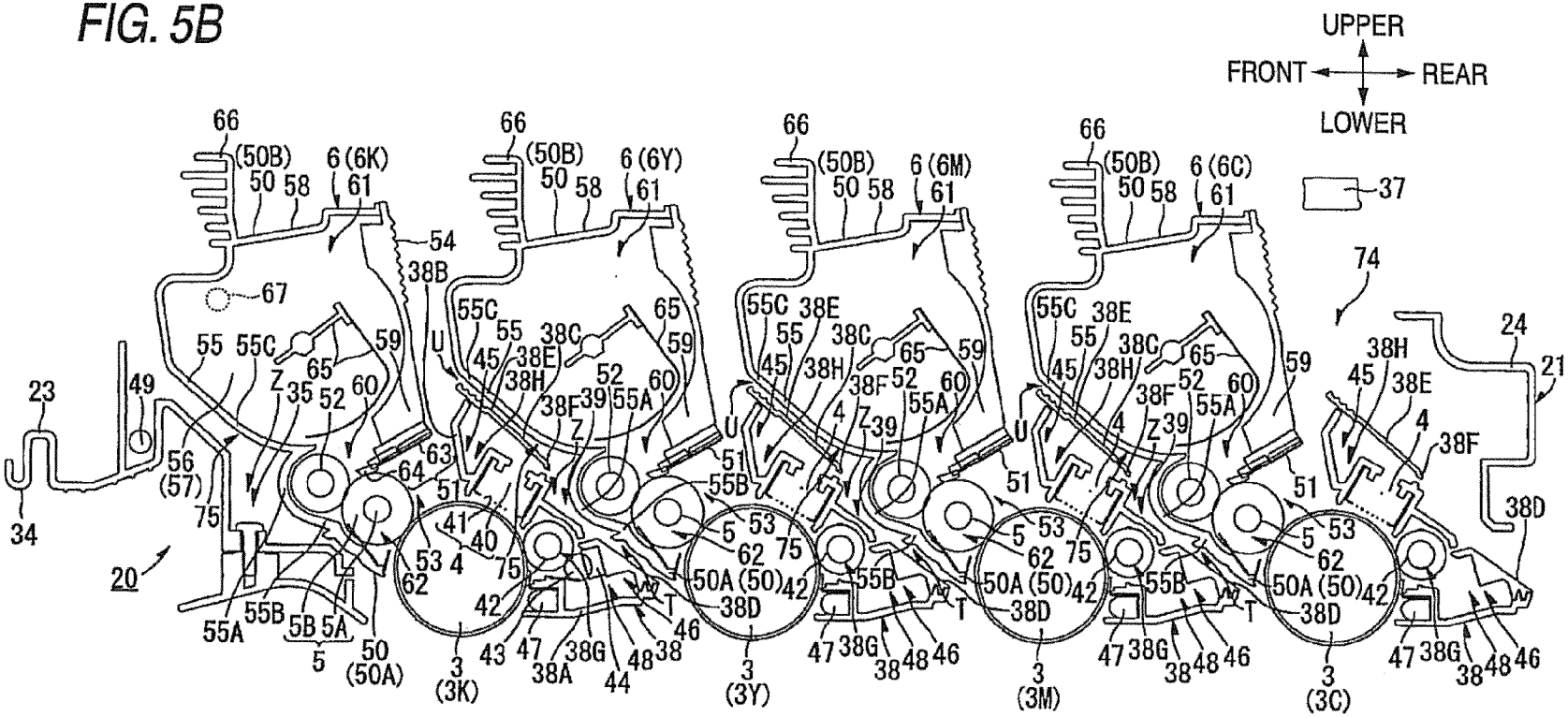
FIG. 5B is a right side cross-sectional view of the process unit, wherein all the developing cartridges of FIG. 5A are in the first position.

Referring to FIG. 5B, the lower end edge of the rear wall 54 extends in the width direction, and is positioned above the lower end of any one of the front, left, and right walls 55, 56, and 57. The above-mentioned opening 53 is defined by the lower end edges of the rear and front walls 54 and 55 and the lower ends of the left and right walls 56 and 57. The opening has a substantially rectangular shape extending in the width direction when viewed from the back side.

A partition wall 59, which continues to the lower end of the rear wall 54 and extends toward the front side (front wall 55), is formed at the developing casing 50 slightly above the lower end of the developing casing 50. A predetermined gap (referred to as a communication port 60) is formed between the front end of the partition wall 59 and the front wall 55. In the developing casing 50, an area above the partition wall 59 forms a toner storage chamber 61 and an area below the partition wall 59 forms a developing chamber 62 which communicates with the opening 53. That is, the partition wall 59 partitions the inside of the developing casing 50 into the toner storage chamber 61 and the developing chamber 62. Further, the toner storage chamber 61 and the developing chamber 62 communicate with each other through the communication port 60.

Here, a portion of the developing casing 50, which is partitioned into the developing chamber 62, is referred to as a first casing portion 50A. A portion of the developing casing 50, which is partitioned into the toner storage chamber 61, is referred to as a second casing portion 50B. The first casing portion 50A is a lower portion of the developing casing 50, and the second casing portion 50B is an upper portion of the developing casing 50.

The developing roller 5 extends in the width direction. In other words, the axis of the developing roller 5 extends in the width direction. The developing roller 5 includes a developing roller shaft 5A which is made of, for example, metal and extends in the width direction, and a cylindrical rubber roller 5B which covers the developing roller shaft 5A except for both end portions of the developing roller shaft in the width direction. The centers of the circular cross sections of the developing roller shaft 5A and the rubber roller 5B are positioned on the axis of the developing roller 5. Both ends of the developing roller shaft 5A in the width direction protrude outward from the developing casing 50 (the left wall 56 and the right wall 57) in the width direction. Further, the developing roller 5 is received in the developing chamber 62 (in other words, the developing roller is held by the first casing portion 50A) and rotatably supported by the developing casing 50 (the left and right walls 56 and 57). The axis of the developing roller 5 corresponds to the rotating shaft of the developing roller 5. The developing roller 5 is exposed to the rear lower side of the opening 53.

The layer thickness regulating blade 51 includes a leaf spring member 63 which is formed in the shape of a thin plate extending in the width direction, and a press-contact rubber 64 which is provided at the front end of the leaf spring member 63. The leaf spring member 63 is provided so as to oppose the above-mentioned partition wall 59 from the rear lower side, and the press-contact rubber 64 comes into press contact with the outer peripheral surface of the developing roller 5 (rubber roller 5B) from above due to the elastic force of the leaf spring member 63.

The supply roller 52 extends in the width direction similarly to the developing roller 5. The supply roller 52 is provided in the vicinity of a boundary between the toner storage chamber 61 and the developing chamber 62 (precisely, below the communication port 60). Specifically, the supply roller 52 is held by the first casing portion 50A, and is rotatably supported by the developing casing 50 similarly to the developing roller 5. The axis of the supply roller 52 corresponds to the rotating shaft of the supply roller 52. In this state, the supply roller 52 opposes the developing roller 5 from the front upper side and comes into contact with the developing roller 5. Here, a middle portion of the front wall 55 in the up-down direction, which corresponds to the supply roller 52, swells toward the front side (the outside of the developing casing 50) so as to curve substantially along the front outer peripheral surface of the supply roller 52, thereby forming a first stepped portion 55A.

A space, which is surrounded by the partition wall 59, the front wall 55 (specifically, the first stepped portion 55A and a lower portion below the first stepped portion 55A), the lower end portion of the left wall 56, and the lower end portion of the right wall 57, is defined as the above-mentioned developing chamber 62.

Toner, which is to be supplied to the developing roller 5, is stored in the toner storage chamber 61 (in the second casing portion 50B). For example, polymerized toner containing one nonmagnetic element is used as the toner. The polymerized toner has substantially spherical particles and has good flowability. Further, an agitator 65 is provided in the toner storage chamber 61. The agitator 65 is rotatable about a rotating shaft extending in the width direction in the toner storage chamber 61.

A lower portion of the front wall 55 corresponding to the first casing portion 50A configures a lower front wall 55B (as an example of a first wall), and opposes the developing roller 5 and the supply roller 52 from the front lower side. Meanwhile, an upper portion of the front wall 55 corresponding to the second casing portion 50B configures an upper front wall 55C (as an example of a second wall), and is adjacent to the lower front wall 558 from above with the above-mentioned first stepped portion 55A therebetween. In other words, the upper front wall 55C is connected to the lower front wall 55B through the first stepped portion 55. The lower and upper front walls 55B and the 55C are substantially parallel to each other, and extend toward the rear lower side (specifically, in the second inclination direction Y shown in FIG. 4). The first stepped portion 55A swells toward the front side (the outside of the developing casing 50) as described above, the lower front wall 55B continues to the front end of the first stepped portion 55A from below, and the upper front wall 55C continues to the rear end of the first stepped portion 55A from above. Accordingly, the upper front wall 55C is in a position which is deviated toward the rear side (the inside of the developing casing 50) in comparison with the lower front wall 55B. And, a recess 75, which extends toward the rear upper side, is formed at the upper portion of the front wall 55 by the upper front wall 55C. In other words, the lower front wall 55B protrudes further than the upper front wall 55C. More specifically, the lower front wall 55B is provided at a side opposite to the rotating shaft of the agitator 65 with respect to a line extending along the upper front wall 55C.

In the state where the developing cartridges 6 are completely mounted in the drawer unit 21 and are in the first position and the contact position as each of the developing cartridges 6 shown in FIG. 5B, each, of the developing cartridges 6 is provided between the beam members 38, which are adjacent to each other in the front-back direction (between the front beam 23 and the foremost beam member 38 in the case of the foremost developing cartridge 6K).

Further, the front wall 55 (the lower front wall 55B and the upper front wall 55C) of each of the developing cartridges 6 is substantially parallel to a reference surface which connects the first portion 27A (see FIG. 4) of one guide groove 27 formed in the right side plate 22 and the first portion 27A of a corresponding guide grove 27 formed in the left side plate 2Z which are in the same position in the front-back direction (oppose each other in the width direction), that is, the reference surface extending in the second inclination direction Y when viewed in the width direction.

As for the three developing cartridges 6Y, 6M, and 6C which are provided on the rear side, in a state where the corresponding developing cartridge 6 (which is adjacent to each of the beam members 38 from the rear side) is mounted in the drawer unit 21, the lower rear wall 38D of each of the three beam members 38 provided on the front side opposes the lower front wall 55B of the developing cartridge 6 from the front lower side with a first distance T therebetween, and the upper rear wall 38E thereof opposes the upper front wall 55C of the developing cartridge 6 from the front lower side with a second distance U therebetween. Here, the first distance T and the second distance U may be substantially equal to each other and may be very small. Since the upper rear wall 38E further protrudes (is further deviated) toward rear upper side in comparison with the above-mentioned lower rear wall 38D, the upper rear wall 38E further protrudes toward the opposing developing cartridge 6 in comparison with the above-mentioned lower rear wall 38D. In other words, the lower rear wall 38D is provided at a side of the charger 4 with respect to the line extending the upper rear wall 38E.

Specifically, in the adjacent beam member 38 and developing cartridge 6, the lower front wall 55B and the first stepped portion 55A of the developing cartridge 6 are fitted to the recess 39 of the beam member 38 from the rear upper side, and the upper rear wall 38E and the second stepped portion 38F of the beam member 38 are fitted to the recess 75 of the front wall 55 of the developing cartridge 6 from the front lower side. In this state, the first stepped portion 55A is positioned on the rear lower side of the second stepped portion 38F, and a gap Z is formed between the first and second stepped portions 55A and 38F in the extending direction of the first portion 27A of the guide groove 27, that is, in the second inclination direction Y shown in FIG. 4.

In the foremost developing cartridge 6K, the front wall 55 is disposed substantially along the rear surface of the front beam 23 with a small gap therebetween and the first stepped portion 55A of the front wall 55 is fitted to the recess 35 of the rear surface of the front beam 23 from the rear upper side.

Further, in each of the four developing cartridges 6, the developing roller 5 opposes the corresponding photosensitive drum 3 from the front upper side and comes into contact with the photosensitive drum 3 as described above. In this state, each of the developing cartridges 6, which is in the first position, is inclined slightly forward as a whole. In this case, the corresponding beam member 38 or the roller 36 of the front beam 23 (see FIGS. 2 and 3) comes into contact with the front wall 55 of each of the developing cartridges 6 (specifically, at the upper front wall 55C which is provided above the first stepped portion 55A) from the front lower side. Accordingly, the first position (inclined state) of the developing cartridge 6 is maintained. As described above, each of the developing cartridges 6 is leaned against the corresponding beam member 38 (which is adjacent to the developing cartridge 6 from the front side) or the front beam 23 from the rear side.

The above-mentioned image formation may be performed when each of the developing cartridges 6 is in the first position and the contact position as shown in FIG. 5B. In each of the developing cartridges 6 at the time of image formation, the toner stored in the toner storage chamber 61 falls into the developing chamber 62 through the communication port 60 and is supplied to the supply roller 52 while being agitated by the rotation of the agitator 65. After that, the toner is supplied to the developing roller 5 by the rotation of the supply roller 52. As the developing roller 5 is rotated, the toner supplied to the developing roller 5 enters between the press-contact rubber 64 of the layer thickness regulating blade 51 and the outer peripheral surface of the developing roller 5 (rubber roller 5B), and the toner is carried to the outer peripheral surface of the developing roller 5 as a thin layer as described above while the layer thickness of the toner is regulated between the press-contact rubber and the outer peripheral surface of the developing roller.

(2) Mount or Detachment of Developing Cartridge on or from Drawer Unit

When the developing cartridges 6 are mounted in the drawer unit 21, referring to FIG. 2, first, the developing cartridge 6 is moved while the grip 68 is gripped so that the developing cartridge 6 is provided above the drawer unit 21 at a position corresponding to the corresponding photosensitive drum 3 in the front-back direction.

Then, the developing cartridge 6 is moved downward and inserted into the drawer unit 21 through the opening 74. As the developing cartridge 6 is inserted into the drawer unit 21, both ends of the developing roller shaft 5A (see the foremost developing cartridge 6 of FIG. 5B), which protrudes from the developing casing 50 (the left wall 56 and the right wall 57) to the outside in the width direction, are fitted to the second portions 27B of the corresponding guide grooves 27, which are formed on the respective side plates 22 of the drawer unit 2L from above. In other words, in the second rearmost developing cartridge 6M shown in FIG. 2, the left end portion of the developing roller shaft 5A is fitted to the second portion 27B of the second rearmost guide groove 27 of the left side plate 22 from above, and the right end portion of the developing roller shaft 5A is fitted to the second portion 27B of the second rearmost guide groove 27, which is formed on the right side plate 22, from above.

Accordingly, referring to FIG. 4, both ends of the developing roller shaft 5A in the width direction are guided by the second portions 27B of the guide grooves 27, so that the developing cartridge 6 is inserted into the drawer unit 21 while being substantially straightly moved toward the substantially rear lower side in the extending direction of the second portion 27B (the downstream side in the first inclination direction X facing the substantially rear lower side). That is, the first inclination direction X is parallel to a mounting direction, along which the developing cartridge 6 is mounted in the drawer unit 21 (hereinafter, simply referred to as a "mounting direction").

Further, when both ends of the developing roller shaft 5A in the width direction reach the lower end of the second portions 27B of the guide grooves 27 and the developing cartridge 6 is then further inserted into the drawer unit 21, both ends of the developing roller shaft 5A in the width direction are guided by the first portions 27A of the corresponding guide grooves 27 in the developing cartridge 6 and then reach the deepest portions of the guide grooves 27 (first portions 27A) due to the weight of the developing cartridge 6 itself.

In this case, in the developing cartridge 6, the left and right bosses 67 shown in FIG. 4 (see the bosses 67 shown by a dotted line in FIG. 4) come into contact with the press cam 32 (see the press cam 32 shown by a dotted line) and the separation cam 33 (see the separation cam 33 which is in the same position as the press cam 32 shown by a dotted line), which are in the waiting position, from above. As described above, when the press cam 32 and the separation cam 33 are in the waiting position, the lower end of the curve surface portion 323 of the press cam 32 opposes the front surface of the separation portion 33D of the separation cam 33 from the front side with a small distance therebetween. For this reason, the respective bosses 67 come into contact with the press cam 32 and the separation cam 33 which are in the waiting position, and cannot descend any more. In this state, each of the bosses 67 is positioned above the pressing surface 32D of the corresponding press cam 32. Further, the developing roller 5 comes into contact with the corresponding photosensitive drum 3 while facing the rotation center 3A (the center of the circular cross section) of the photosensitive drum 3 from the front upper side in the second inclination direction Y.

Accordingly, the entire developing cartridge 6 cannot descend (or be moved straight toward the rear lower side) any more. The position of the developing cartridge 6 in this state is referred to as a second position (see also the second rearmost developing cartridge 6M of FIG. 5A).

In the state where the developing cartridge 6 is in the second position, as described above, the developing roller 5 comes into contact with the photosensitive drum 3 from the front upper side and both ends of the developing roller shaft 5A of in the width direction reach the deepest portions of the guide grooves 27 (first portions 27A). Specifically, as shown in FIG. 4, both ends of the developing roller shaft 5A in the width direction are fitted between the opposite surfaces 28C of the pair of corresponding guide ribs 28. Accordingly, the position of the developing roller 5 is determined. Here, it is understood that the guide grooves 27 guide the developing roller 5 of the developing cartridge 6, which is to be mounted in the drawer unit 21, to the corresponding photosensitive drum 3.

Further, if the first and second portions 27A and 27B of the guide groove 27 are defined based on the mounting direction (toward the rear lower side), the first portion 27A extends in the second inclination direction Y toward the rotation center 3A of the photosensitive drum 3 as directing to a downstream side in the mounting direction at a downstream end of the guide groove 27 in the mounting direction. In other words, the first portion 27A is provided at the downstream end of the guide groove 27 in the mounting direction and extends toward the rotation center 3A of the photosensitive drum 3 as directing to the downstream side in the mounting direction. Further, the second portion 27B continues to the opening 74 and extends in a direction (the first inclination direction X) intersecting the first portion 27A toward the downstream side in the mounting direction on an upstream side of the guide groove 27 in the mounting direction. In other words, the second portion 27B is provided at the upstream side of the guide groove 27 in the mounting direction and extends from the opening 74 in the first inclination direction X, toward the downstream side in the mounting direction.

Referring to the second rearmost developing cartridge 6M shown in FIG. 5A, in the state where the developing cartridge 6 is in the second position, the rear wall 54 is parallel to the vertical direction in comparison with the state where the developing cartridge is in the first position (see the developing cartridges 6 except for the developing cartridge 6M shown in FIG. 5A). Accordingly, the developing cartridge 6 is erected as a whole. In this case, the developing cartridge 6 (specifically, the periphery of the rear wall 54), which is in the second position, is in a position interfering with an area through which a laser beam emitted from the scanner unit 7 to the photosensitive drum 3 corresponding to the developing cartridge 6 (the photosensitive drum 3M in the case of the developing cartridge 6M) passes as shown by an arrow of broken line in FIG. 1.

Further, when the developing cartridge 6 is in the second position, the first stepped portion 55A and the lower front wall 55B are located away from the recess 39 of the rear wall 38C toward the rear upper side and the front wall 55 is separated from the rear wall 38C of the beam member 38, which is adjacent to the developing cartridge 6 from the front side, toward the rear upper side in comparison with when the developing cartridge is in the first position. Meanwhile, although not shown, when the developing cartridge 6K (the foremost developing cartridge 6) is in the second position, the first stepped portion 55A is located away from the recess 35 of the rear surface of the front beam 23 toward the rear upper side and the front wall 55 is separated from the rear surface of the front beam 23 toward the rear upper side in comparison with when the developing cartridge is in the first position. Here, the developing cartridge 6 (particularly, the front wall 55) does not come into contact with the beam member 38 or the front beam 23, which is adjacent to the developing cartridge 6 from the front side, between when the developing cartridge 6 begins to be inserted into the drawer unit 21 and when the developing cartridge 6 is in the second position.

Furthermore, when the grip 68 (see FIG. 2) is gripped and turned forward while the developing cartridge 6 is in the second position (see the developing cartridge 6M shown in FIG. 5A), the developing cartridge 6 is rotated (inclined) forward about the developing roller 5, which has been positioned (which has reached the first portion 27A of the guide groove 27 shown in FIG. 4). Accordingly, the position of the developing cartridge 6 is changed from the second position to the first position (see the developing cartridge 6M shown in FIG. 5B).

When the developing cartridge 6 is in the first position (see the developing cartridges 6 except for the developing cartridge 6M shown in FIG. 5A), as described above, the lower rear wall 38D of the corresponding beam member 38 (which is adjacent to the developing cartridge 6 from the front side) opposes the lower front wall 55B of the developing cartridge 6 with the first distance T therebetween and the upper rear wall 38E thereof opposes the upper front wall 55C of the developing cartridge 6 with the second distance U therebetween. In the state where the developing cartridge 6 is in the first position, the developing cartridge 6 is in a position which does not interfere with the above-mentioned area through which the laser beam passes (see an arrow shown by a broken line in FIG. 1).

A state where the position of the developing cartridge 6 is changed from the second position to the first position will be further described with reference to FIG. 4. Referring to the front press cam 32 shown in FIG. 4, when the developing cartridge 6 in the second position, as described above, each of the left and right bosses 67 (see the boss 67 shown by a dotted line in FIG. 4) comes into contact with the press cam 32 (see the press cam 32 shown by a dotted line) and the separation cam 33, which are in the waiting position, from above. Here, the lower end of the curve surface portion 32B of the press cam 32 opposes the front surface of the separation portion 33D of the separation cam 33 from the front side with a small distance therebetween. The bosses 67 come into contact with the lower portion of the curve surface portion 32B of the press cam 32, which is in the waiting posture, from the rear side, and come into contact with the cut-out front upper end portion of the separation portion 33D of the separation cam 33, which is in the waiting posture, from above, respectively.

In this state, when the developing cartridge 6 is rotated forward about the positioned developing roller 5 as described above so as to be in the first position, each of the bosses 67 is rotated about the developing roller 5 toward the front lower side and presses the lower end of the curve surface portion 32B of the press cam 32, which is in the waiting position (see the press cam 32 shown by a dotted line), toward the front side. Accordingly, the press cam 32, which is in the waiting position, is rotated forward against a pushing force of the above-mentioned pushing member (not shown) which pushes the press cam 32 so as to change the position of the press cam 32 from the pressing position to the waiting position. Accordingly, the position of the press cam 32 is changed to the pressing position (see the press cam 32 shown by a solid line).

Here, when the developing cartridge 6 is in the second position, a contact position where the boss 67 and the press cam 32 (curve surface portion 32B) come into contact with each other is set so that the rotating shaft 32C of the press cam 32 does not exist on a straight line passing in a direction where the boss 67 (see the boss 67 shown by a dotted line) presses the press cam 32. For this reason, the press cam 32 is pressed by the boss 67, so that the press cam 32 is smoothly rotated toward the front upper side.

The position of the press cam 32 is changed from the waiting position (see the press cam 32 shown by a dotted line) to the pressing position (see the press cam 32 by a solid line), so that the press cam 32 (specifically, the curve surface portion 32B) is separated from the separation cam 33 (specifically, the front surface of the separation portion 33D) toward the front upper side. In accordance with this, each of the bosses 67 enters a gap between the press cam 32 and the separation portion 33D of the separation cam 33 while continuing to be rotated toward the front lower side (see the boss 67 shown by a solid line in FIG. 4). As a result, the position of the developing cartridge 6 is changed from the second position (see the developing cartridge 6M shown in FIG. 5A) to the first position (see the developing cartridge 6M shown in FIG. 5B).

Here, with attention focused on the press cam 32 while the position of the developing cartridge 6 is changed from the second position to the first position, the press cam 32 comes into contact with the boss 67 from the front side at first (see the boss 67 and the press cam 32 shown by a dotted line in FIG. 4) and is then moved around the boss 67 to the front upper side while maintaining a contact state (see the boss 67 and the press can 32 shown by a solid line in FIG. 4). Accordingly, while the position of the developing cartridge 6 is changed from the second position to the first position, the press cam 32 does not press the boss 67 (that is, the developing cartridge 6), at least, upward. Therefore, the developing cartridge 6 does not suddenly ascend.

When the developing cartridge 6 is in the first position, each of the bosses 67 is positioned below the pressing surface 32D of the press cam 32 as shown by a solid line and is interposed between the pressing surface 32D and the front surface of the separation portion 33D of the separation cam 33 in the front-and-rear (up-and-down) direction. When the developing cartridge 6 is in the second position as described above, each of the bosses 67 is positioned above the pressing surface 32D of the corresponding press cam 32 (see the boss 67 shown by a dotted line). After that, when the position of the developing cartridge 6 is changed from the second position to the first position, each of the bosses 67 is moved from the upper side of the corresponding pressing surface 32D to the lower side thereof.

Further, when the developing cartridge 6 is in the first position, the press cam 32 (see the front press cam 32 shown by a solid line) is always pushed by the above-mentioned pushing member (not shown) in a direction where the position of the press cam returns to the waiting position (see the press cam 32 shown by a dotted line), that is, in a direction where the press cam 32 is rotated toward the rear lower side. Accordingly, each of the bosses 67 is positioned below the pressing surface 32D of the press cam 32 and is engaged with the pressing surface 32D, so that each of the bosses 67 is pressed toward the rear lower side (the front surface of the separation portion 33D of the separation cam 33) by the pressing surface 32D. In other words, when the corresponding boss 67 is positioned below the pressing surface 32D, the pressing surface 32D presses the boss 67.

A force of the pressing surface 32D of the press cam 32, which presses each of the bosses 67 (acting toward the rear lower side), is a resultant force of a force which is applied in the second inclination direction Y (a direction toward the rear lower side) and a force which prevents the developing cartridge 6 from ascending. Accordingly, the pressing surface 32D of the press cam 32 presses each of the bosses 67, so that the entire developing cartridge 6 (see FIG. 2) provided with these bosses 67 is pressed toward the downstream side (rear lower side) in the second inclination direction Y (in the extending direction of the first portion 27A of the guide groove 27). Further, in accordance with this, the developing roller 5 comes into press contact with the corresponding photosensitive drum 3 from the front upper side toward the rotation center 3A of the photosensitive drum 3 while being guided by the first portion 27A of the guide groove 27 (see FIG. 5B).

That is, when the developing cartridge 6 is in the first position, the pressing surface 32D presses the developing cartridge 6 so that the developing roller 5 opposes the corresponding photosensitive drum 3. Further, in this state, the developing cartridge 6 is completely mounted in the drawer unit 21 (see each of the developing cartridges 6 of FIG. 5B).

When all the developing cartridges 6 are set to the second position and then set to the first position according to this procedure, all the developing cartridges 6 are completely mounted in the drawer unit 21. As a result, the process unit 20 becomes a complete state (see FIG. 5B).

Here, it is understood that the press cams 32 (specifically, the pressing surfaces 32D) are provided at the same positions as both ends of the corresponding developing cartridge 6, which is mounted in the drawer unit 21, in the width direction, as shown in FIG. 2.

Meanwhile, when the developing cartridge 6 is separated from the drawer unit 21, the developing cartridge may be separated from the drawer unit in a reverse order to how the developing cartridge 6 is mounted in the drawer unit 21. That is, first, the grip 68 is gripped and turned rearward. Accordingly, like the developing cartridge 6M shown in FIG. 5A, the entire developing cartridge 6 is rotated (inclined) rearward about the developing roller 5. Therefore, the position of the developing cartridge 6 is changed from the first position to the second position. When the developing cartridge 6 is in the second position (see the developing cartridge 6M of FIG. 5A), referring to FIG. 4, each of the bosses 67 is provided above the pressing surface 32D of the corresponding press cam 32 (see the press cam 32 shown by a dotted line) and is located away from the pressing surface 32D as described above. Accordingly, the pressure, which is applied to each of the bosses 67 from the pressing surface 32D, is released (see the boss 67 shown by a dotted line). In other words, when the developing cartridge 6 is in the second position, the pressure applied by the pressing surface 32D is released, so that a force for pressing the developing cartridge 6 toward the downstream side (rear lower side) in the second inclination direction Y is not applied. As a result, the developing cartridge 6, which is in the second position, can be moved upward and separated from the drawer unit 21.

Further, when the developing cartridge 6 is in the second position, the entire developing cartridge 6 ascends by pulling up the grip 68 (see FIG. 2). When both ends of the developing roller shaft 5A are separated upward from the corresponding guide groove 27 and the entire developing cartridge 6 is thus moved to the upper side of the opening 74 of the drawer unit 21, the developing cartridge 6 is completely separated from the drawer unit 21.

As described above, referring to the developing cartridge 6M of FIGS. 5A and 5B, the position of each of the developing cartridges 6 can be changed between the first position (see FIG. 5B) and the second position (see FIG. 5A) in the drawer unit 21. Further, it is understood that each of the developing cartridges 6 to be mounted in or detached from the drawer unit 21 passes through the opening 74 of the drawer unit 21.

(3) Mount or Detachment of Process Unit with Respect to Main Body Casing

The mount or detachment of the process unit 20 with respect to the main body casing 2 will be described below.

Figure 6:
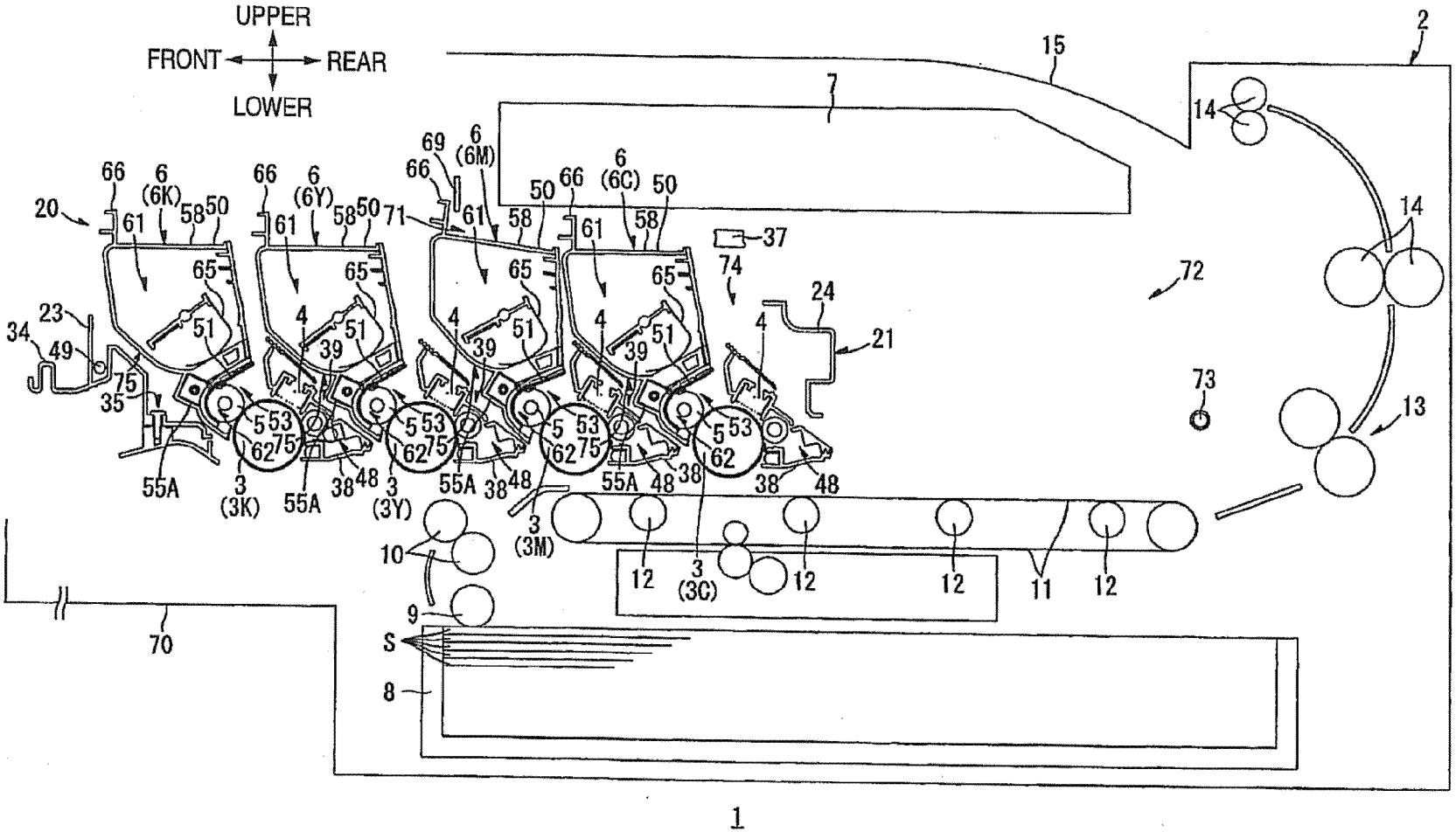
FIG. 6 is a right side cross-sectional view of the printer, wherein the process unit of FIG. 5A is being mounted in a main body casing.
Figure 7:
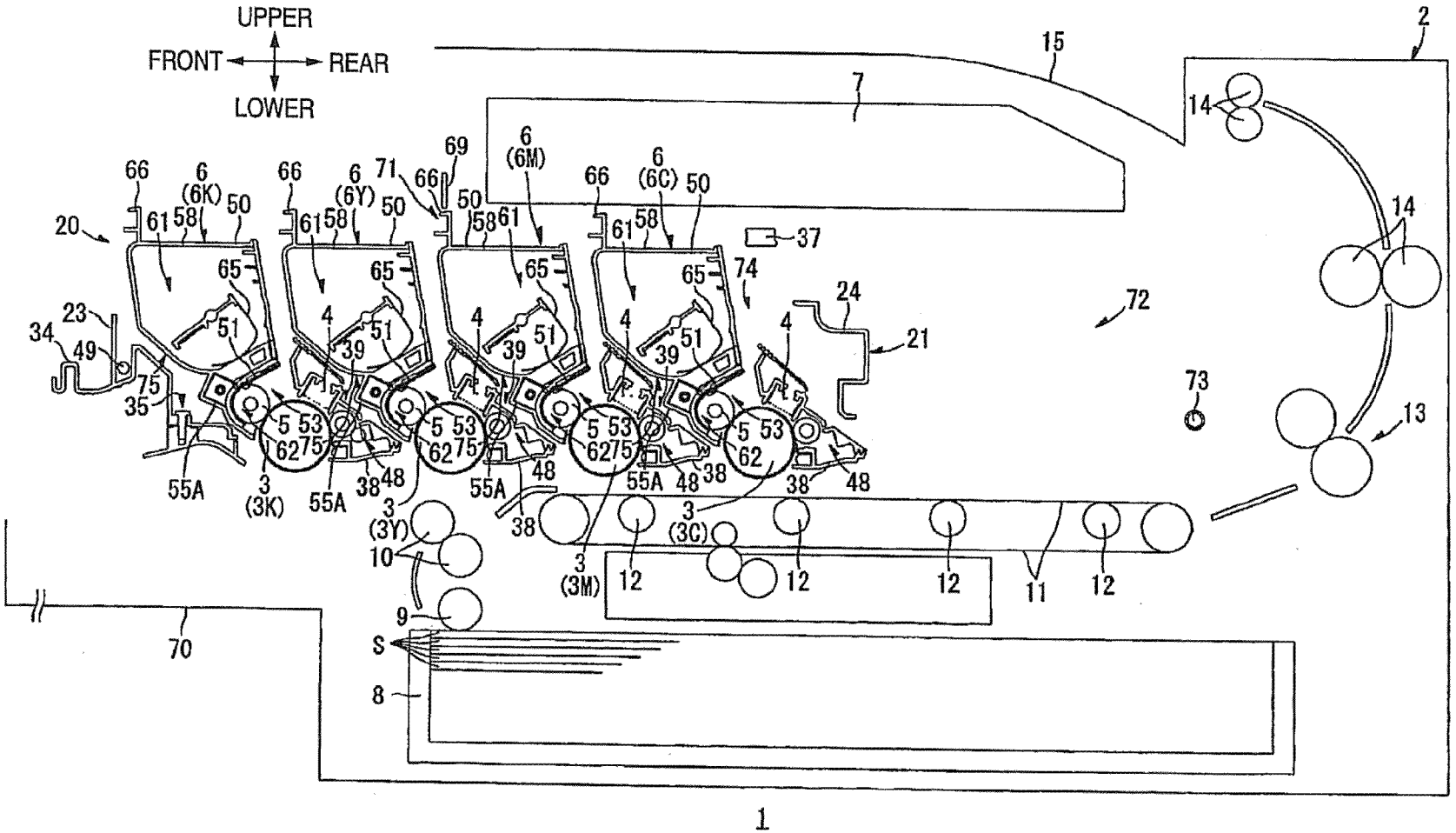
FIG. 7 is a right side cross-sectional view of the printer, wherein the process unit of FIG. 5B is being mounted in the main body casing.

First, referring to FIG. 1, a cover 70 is provided on the front wall of the main body casing 2. The cover 70 is rotatable about the lower end thereof. Specifically, the cover is rotated between a closed position where the cover is erected as shown in FIG. 1 and an open position where the cover is inclined forward as shown in FIGS. 6 and 7.

When the cover 70 is in the open position, a mounting port 71 is formed on the front surface of the main body casing 2. The mounting port 71 has a size so that the process unit 20 to be mounted in or detached from the main body casing 2 can pass through, the mounting port in the front-back direction. The mounting port communicates with a space (referred to as a receiving space 72), where the process unit 20 is received in the main body casing 2, from the front side.

The upper end of the receiving space 72 is partitioned by the scanner unit 7, and the lower end thereof is partitioned by the transport belt 11. A positioning shaft 73, which extends in the width direction and is provided between left and right side walls of the main body casing 2, is provided at the rear end of the receiving space 72.

Further, a contacting portion 69 is formed at the upper end portion of the mounting port 71 of the main body casing 2 (specifically, at the upper end portion of the front end of the receiving space 72 on the front side of the scanner unit 7). The contacting portion 69 has the shape of, for example, a plate which extends substantially vertically in the width direction, and the lower end portion of the contacting portion is positioned slightly below the lower end of the scanner unit 7 in the up-down direction. When the cover 70 is in the open position, the contacting portion 69 is exposed to the front side through the mounting port 71.

The process unit 20 is mounted in this main body casing 2. For this purpose, first, the cover 70 is rotated in the open position as shown in FIG. 6 so that the mounting port 71 is opened.

Further, the front and rear handles 34 and 37 are gripped and the process unit 20 is provided on the front side of the mounting port 71. Then, the rear end of the process unit 20 is inserted into the mounting port 71 from the front side. In this state, the left and right guide rails 25 and rollers 26 (see FIG. 2) of the drawer unit 21 of the process unit 20 are engaged with guide members (not shown) provided in the receiving space 72. Accordingly, while each of the photosensitive drums 3 is separated slightly upward from the transport belt 11 (when the process unit 20 itself does not come into contact with the transport belt 11), the process unit 20 is received in the mounting port 71.

In this state, when the front handle 34 is gripped and the process unit 20 is pushed rearward, the above-mentioned guide rails 25 and rollers 26 (see FIG. 2) are guided by the above-mentioned guide members (not shown) provided in the receiving space 72 and the process unit 20 is inserted into the receiving space 72 toward the rear side in the substantially horizontal direction while not coming into contact with the transport belt 11.

Here, if the position of the developing cartridge 6 is the first position such as the rearmost developing cartridge 6C of the process unit 20, the contacted portion 66 of the upper end of the developing cartridge 6 (developing cartridge 6C) is positioned below the contacting portion 69 of the upper end of the mounting port 71. Accordingly, as the process unit 20 is inserted into the receiving space 72, the developing cartridge 6, which is in the first position, passes through the mounting port 71 toward the rear side without coming into contact with the contacting portion 69.

However, if the position of the developing cartridge is in the second position such as the second rearmost developing cartridge 6M, the contacted portion 66 of the developing cartridge 6 corresponds to the contacting portion 69 in the up-down direction (height direction). Accordingly, when the developing cartridge 6 (developing cartridge 6M), which is in the second position, passes through the mounting port 71 toward the rear side as the process unit 20 is inserted into the receiving space 72, the contacting portion 69 is brought into contact with the contacted portion 66 (specifically, the rear edge 66C of each of the ribs 66A shown in FIG. 2) of the developing cartridge 6 from the rear side.

Accordingly, the developing cartridge 6M, which is in the second position, is rotated (inclined) forward so that the position of the developing cartridge is changed into the first position as shown in FIG. 7. Then, the developing cartridge passes through the mounting port 71 toward the rear side without coming into contact with the contacting portion 69.

When the process unit 20 is mounted in the main body casing 2, the contacting portion 69 of the main body casing 2 comes into contact with the contacted portion 66 of the developing cartridge 6 which is in the second position. As a result, the position of the developing cartridge 6 is changed from the second position to the first position.

Further, the developing cartridge 6 which is in the second position (see the developing cartridge 6M of FIG. 6), is inclined toward the upstream side (front side) in the mounting direction (a direction toward the rear side), so that the position of the developing cartridge is changed from the second position to the first position (see the developing cartridge 6M of FIG. 7). Here, with respect to the mounting direction, it is understood that the contacted portion 66 of each developing cartridge 6, which is provided in the front area of the top wall 58 of the developing casing 50, is provided on the upstream side in the mounting direction.

Here, the contacted portion 66 may be pushed up by a spring (not shown) and the contacting portion 69 may be pushed down by a spring (not shown) so that the contacted portion 66 of the developing cartridge 6, which is in the second position (see the developing cartridge 6M of FIG. 6), corresponds to the contacting portion 69 in the up-down direction. In this state, the contacting portion 69 necessarily comes into contact with the contacted portion 66 of the developing cartridge 6 which is in the second position.

Further, when the process unit 20 is completely inserted into the receiving space 72 as shown in FIG. 1, the above-mentioned guide rails 25 and rollers 26 (see FIG. 2) of the process unit 20 are uncoupled from the above-mentioned guide members (not shown) provided in the receiving space 72. Accordingly, the process unit 20 descends and each of the photosensitive drums 3 comes into contact with the transport belt 1I from above.

After that, when the cover 70 is moved to the closed position, the process unit 20 is completely mounted in the main body casing 2. In this case, the positioning shaft 73 of the main body casing 2 is engaged with the rear beam 24 of the drawer unit 21 of the process unit 20 from the rear side, and the positioning shaft 49 of the process unit 20 is engaged with the main body casing 2. Accordingly, the position of the process unit 20, which is mounted in the main body casing 2, is fixed.

Meanwhile, when the process unit 20 mounted in the main body casing 2 is removed from the main body casing 2, the cover 70 is moved to the open position and the process unit 20 is drawn to the front side as shown in FIG. 7 while the front handle 34 is gripped. In this case, the contacted portion 66 of each developing cartridge 6, which is in the first position, does not come into contact with the contacting portion 69 or the bottom surface of the scanner unit 7. Accordingly, while the process unit 20 is drawn to the front side, the contacted portion 66 is not caught by the contacting portion 69 or the bottom surface of the scanner unit 7. Accordingly, the position of the developing cartridge 6 is not changed from the first position to the second position (see the developing cartridge 6M of FIG. 6). Further, when the process unit 20 is drawn until the entire process unit 20 is positioned in front of the mounting port 71, the process unit 20 is completely removed from the main body casing 2.

Meanwhile, when the process unit 20 is mounted in the main body casing 2 as shown in FIG. 1, coupling members (not shown) provided in the main body casing 2 are inserted into the respective insertion holes 29 (see FIGS. 2 and 4), which are formed at the left side plate 22 of the drawer unit 21 of the process unit 20, and are connected to the respective developing cartridges 6. In this state, a driving force, which is generated by a motor (not shown) provided in the main body casing 2, is transmitted to the respective developing cartridges 6 through the coupling member (not shown). Accordingly, the developing roller 5, the supply roller 52, or the agitator 65 of each of the developing cartridges 6 is rotated at the time of image formation.

(4) Others

When the process unit 20 is mounted in the main body casing 2 as shown in FIG. 1, all the (four) developing cartridges 6 of the process unit 20 are in the first position and the contact position (see also FIG. 5B). Accordingly, as described above and shown by a solid line in FIG. 4, each of the bosses 67 of each developing cartridge 6 is pressed toward the rear lower side by the pressing surface 32D of the press cam 32 (see the front press earn 32 shown by a solid line) which is in the pressing position, and is pressed toward the front surface of the separation portion 33D of the separation cam 33 which is in the waiting position.

Accordingly, as described above, the entire developing cartridge 6 including the bosses 67 is pressed toward the downstream side (rear lower side) in the second inclination direction Y, and the developing roller 5 comes into press contact with the corresponding photosensitive drum 3 from the front upper side toward the rotation center 3A of the photosensitive drum 3 (see also FIG. 5B).

Further, when the developing rollers 5 of all the developing cartridges 6 come into press contact with the corresponding photosensitive drums 3 from the front upper side as shown in FIG. 1 (that is, when all the developing cartridges 6 are in the contact positions), the electrostatic latent images of all the photosensitive drums 3 are changed to visible images. Accordingly, a color image is formed on the sheet S as described above.

Here, the printer 1 can perform not only a color printing mode for forming a color image (see FIG. 1) but also a monochrome printing mode (see FIG. 8) for forming a monochrome image.

When the color printing mode is changed to the monochrome printing mode, referring to FIG. 4, the protrusions 33F of the separation cams 33, of which the separation portions 33D oppose the respective bosses 67 of the respective developing cartridges 6Y, 6M, and 6C except for the developing cartridge 6K from the rear lower side, are pushed up by the main body casing 2 (see FIG. 1). Accordingly, the position of the separation cam is changed to the above-mentioned separation position (not shown) from the waiting position. As a result, the separation portion 33D is deviated toward the front upper side as described above (not shown).

Here, as described above, a direction where the separation portion 33D is deviated (a direction toward the front upper side) is substantially parallel to the second inclination direction Y (see an arrow shown by a thick dashed line). Further, both ends of the developing roller shaft 5A in the width direction are fitted between the opposite surfaces 28C (in the first portions 27A of the guide grooves 27) of the pair of guide ribs 28 (the front and rear ribs 28A and 28B), and the opposite surfaces 28C (the first portions 27A) extend parallel to each other in the second inclination direction Y.

Figure 8:
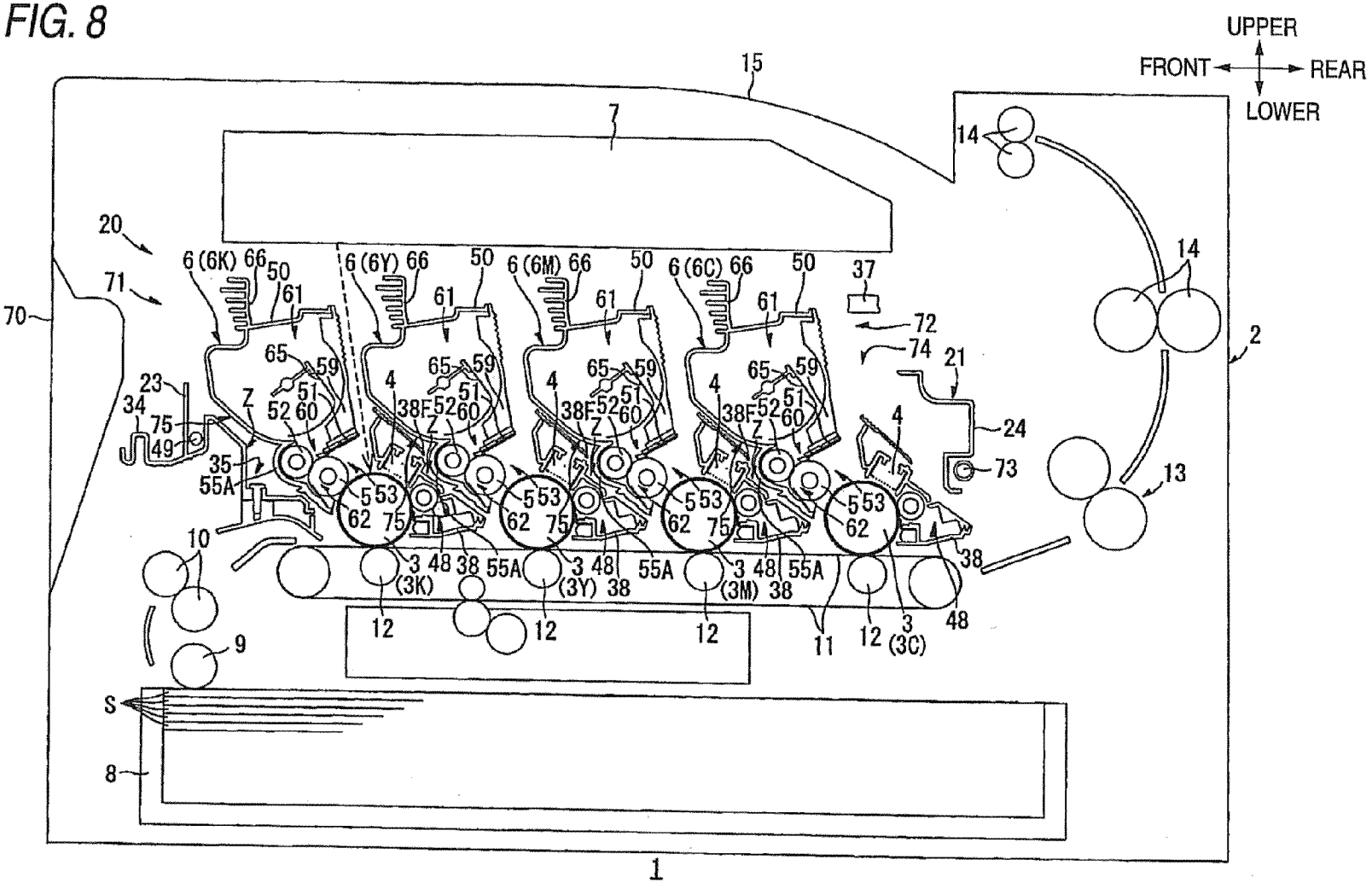
FIG. 8 is a right side cross-sectional view of the printer during monochrome printing.

Therefore, when the position of the separation earn 33 is changed from the waiting position to the separation position and the separation portion 33D is thus deviated toward the front upper side (the upstream side in the second inclination direction Y), the boss 67 of each of the developing cartridges 6Y, 6M, and 6C (see FIG. 8) is pressed toward the front upper side by the corresponding separation portion 33D. Accordingly, all the developing cartridges 6Y, 6M, and 6C are deviated from the contact position toward the front upper side (the upstream side in the second inclination direction Y). As a result, as shown in FIG. 8, the developing rollers 5 of the developing cartridge 6Y, 6M, and 6C are separated from the corresponding photosensitive drums 3Y, 3M, and 3C toward the front upper side, respectively. When the developing roller 5 is separated from the photosensitive drum 3, the position of the developing cartridge 6 is referred to as a separation position. Meanwhile, when the position of the separation cam 33 (see FIG. 4) is changed from the separation position to the waiting position, the developing cartridge 6, which is in the separation position, can be deviated toward the rear lower side (the downstream side in the second inclination direction Y) and return to the contact position (see FIG. 1).

Meanwhile, since the developing roller 5 remains in press contact with the corresponding photosensitive drum 3K in the developing cartridge 6K corresponding to black, the electrostatic latent image formed on the photosensitive drum 3K can be changed to a visible image. This state is a monochrome printing mode, and only a black image (monochrome image) is formed on the sheet S.

Further, the printer 1 can also perform an all-separation mode where all the developing cartridges 6 are moved to the separation position from the contact position (the developing rollers 5 of all the developing cartridges 6 are separated from the corresponding photosensitive drums 3).

When being mounted in the drawer unit 21 as described above, the respective developing cartridges 6 can move by only a predetermined distance in the extending direction of the first portion 27A of the guide groove 27 (in the second inclination direction Y shown in FIG. 4) between the contact position (see all the developing cartridges 6 of FIG. 1) and the separation position (see the developing cartridges 6Y, 6M, and 6C of FIG. 8).

Here, when the developing cartridge 6 is in the contact position, the lower rear wall 38D of the corresponding beam member 38 (which is adjacent to the developing cartridge 6 from the front side) opposes the lower front wall 55B of the developing cartridge 6 with the first distance T therebetween and the upper rear wall 38E thereof opposes the upper front wall 55C of the developing cartridge 6 with the second distance therebetween as described above and shown in FIG. 5B. Further, as described above, the gap Z is maintained between the first stepped portion 55A of the developing cartridge 6 and the second stepped portion 38F of the beam member 38 in the extending direction of the first portion 27A of the guide groove 27 (which is the second inclination direction Y shown in FIG. 4 and extends toward the front upper side and the rear lower side).

Furthermore, even though the developing cartridge 6 is moved to the separation position from the contact position toward the front upper side (see the developing cartridges 6Y, 6M, and 6C of FIG. 8), the lower rear wall 38D of the corresponding beam member 38 opposes the lower front wall 55B of the developing cartridge 6 with the first distance T therebetween and the upper rear wall 38E thereof opposes the upper front wall 55C of the developing cartridge 6 with the second distance U therebetween. Moreover, the gap Z is maintained between the first stepped portion 55A of the developing cartridge 6 and the second stepped portion 38F of the beam member 38 in the extending direction of the first portion 27A of the guide groove 27 (in the second inclination direction Y shown in FIG. 4) (see the developing cartridges 6Y, 6M, and 6C of FIG. 8).

Meanwhile, when the foremost developing cartridge 6K is in the contact position, the first stepped portion 55A of the front wall 55 of the developing cartridge 6K is fitted to the recess 35 of the rear surface of the front beam 23 from the rear upper side as described above. Further, even though the developing cartridge 6K is moved to the separation position from the contact position toward the front upper side (not shown), the first stepped portion 55A continues to be fitted to the recess 35 of the rear surface of the front beam 23 from the rear upper side and the gap Z is maintained on the front upper side of the first stepped portion 55A in the recess 35.

3. Advantages (1) As described above, the process unit 20 includes the drawer unit 21, the photosensitive drums 3, the chargers 4, and the developing cartridges 6 as shown in FIG. 5B. The photosensitive drums 3 are held by the drawer unit 21 to be in parallel with each other and arranged in a predetermined direction (front-back direction). The chargers 4 are provided so as to oppose the photosensitive drums 3, respectively, and the charger charges the corresponding photosensitive drum 3 with electricity. The developing cartridges 6 include developing rollers 5, receive toner, and are detachably mounted in the drawer unit 21. The developing roller 5 of each of the developing cartridges 6 supplies toner to the corresponding photosensitive drum 3 and develops an electrostatic latent image formed on the photosensitive drum 3 into a visible image. Accordingly, the developing cartridges 6 are mounted in the drawer unit 21 to be in parallel with each other and arranged in the front-back direction, similarly to the photosensitive drums 3.

As shown in FIG. 2, the drawer unit 21 includes the pair of side plates 22 and the beam members 38. The side plates 22 are provided on both sides of each of the photosensitive drums 3 in the width direction, and the photosensitive drums 3 are rotatably supported by the side plates 22. The beam members 38 are provided between the pair of side plates 22 and hold the corresponding chargers 4, respectively. Further, the opening 74, through which each of the developing cartridges 6 to be mounted in or detached from the drawer unit 21 passes, is provided at the drawer unit 21.

Here, the guide grooves 27 are formed on each of the side plates 22. As shown in FIG. 4, the guide groove 27 extends from the opening 74 toward the downstream side (rear lower side) in the mounting direction, and guides the developing roller 5 of each of the developing cartridges 6 to be mounted in the drawer unit 21 to the photosensitive drum 3.

Each of the guide grooves 27 includes at least first and second portions 27A and 27B. The first portion 27A is provided at a downstream end (lower end) in the mounting direction and extends toward the rotation center 3A of the photosensitive drum 3 as directing to the downstream side in the mounting direction. The second portion 27B is provided at the upstream side (upper side) in the mounting direction and extends from the opening 74 in a direction (the first inclination direction X) intersecting the first portion 27A (the second inclination direction Y) toward the downstream side in the mounting direction.

According to this configuration, it is possible to make the developing roller 5 of the developing cartridge 6, which is mounted in the drawer unit 21, oppose the corresponding photosensitive drum 3 toward the rotation center 3A of the photosensitive drum 3 at the first portion 27A of each of the guide grooves 27. Accordingly, the position of the developing roller 5 relative to the photosensitive drum 3 is stable, so that the developing roller 5 can stably supply toner to the photosensitive drum 3.

Figure 9B:
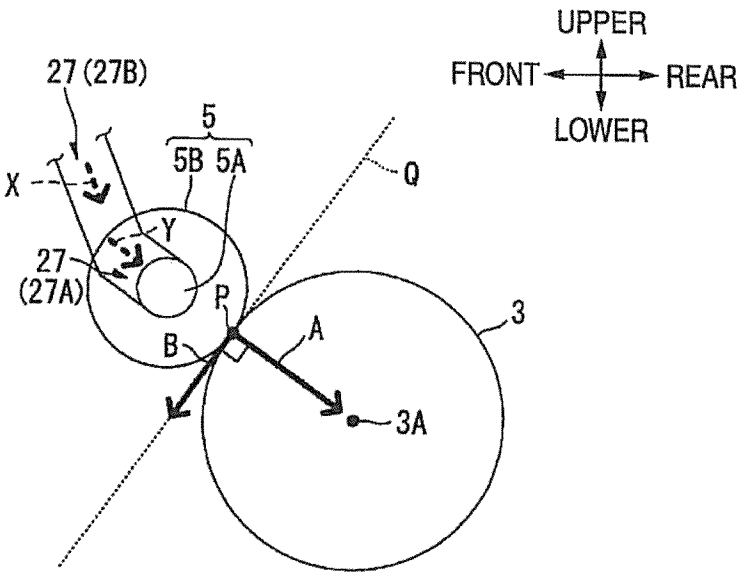
FIG. 9B is a schematic view illustrating relative positions of a photosensitive drum and a developing roller which reaches the deepest portion of the guide groove according to the embodiment of the present invent.
Figure 9A:
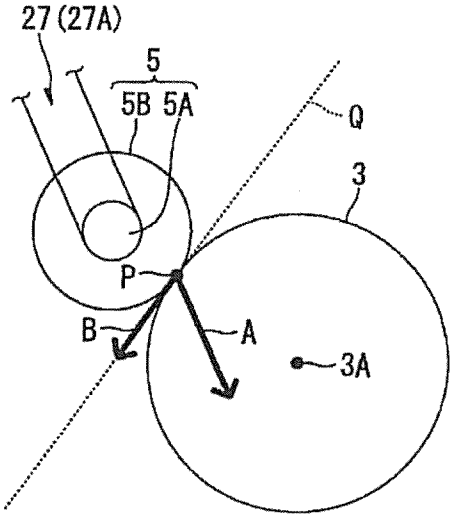
FIG. 9A is a schematic view illustrating relative positions of a photosensitive drum and a developing roller which reaches the deepest portion of a guide groove having a shape different from that of a guide groove according to the embodiment of the preset invention.

Specifically, if the deepest portion (first portion 27A) of the guide groove 27 extends toward a position deviated from the rotation center 3A of the photosensitive drum 3 as shown in FIG. 9A unlike the above-described embodiment, a pressing force A, which is applied to the photosensitive drum 3 by the developing roller 5, is applied to the photosensitive drum 3 toward a position deviated from the rotation center 3A at a contact position P between the photosensitive drum 3 and the developing roller 5. In contrast, if the first portion 27A of the guide groove 27 extends toward the rotation center 3A of the photosensitive drum 3 similarly to the above-described embodiment shown in FIG. 9B, a pressing force A, which is applied to the photosensitive drum 3 by the developing roller 5, is applied to the photosensitive drum 3 toward the rotation center 3A at a contact position P where the photosensitive drum 3 and the developing roller 5 came into contact with each other. Since the pressing force A is applied to the rotation center 3A (centroid) of the photosensitive drum 3 in the above-described embodiment, it may be possible to make the developing roller 5 come into press contact with the photosensitive drum 3 with a strong pressing force (in other words, with stability) in comparison with when the pressing force is not applied to the rotation center of the photosensitive drum (see FIG. 9A).

Further, in the ease of either of FIGS. 9A and 9B, the developing roller 5 is generally rotated at high speed in comparison with the photosensitive drum 3. The rotational direction of the photosensitive drum 3 is a counterclockwise direction, and the rotational direction of the developing roller 5 is a clockwise direction. Due to the difference in rotational speed, a frictional force B, which is applied in the same direction as the rotational direction of the developing roller 5, is generated on the developing roller 5 at the contact position P along a tangent line Q of the photosensitive drum 3 and the developing roller 5. Since a pressing force A and a frictional force B are orthogonal to each other in the above-described embodiment shown in FIG. 9B, the pressing force A can make the developing roller 5 stably come into press contact with the photosensitive drum 3 without being affected by the frictional force B. In contrast, since the pressing force A and the frictional force B are not orthogonal to each other in the case of FIG. 9A, a component force, which is applied in a direction extending parallel to the pressing force A, is generated in the frictional force B. Since the pressing force A is affected by the component force, it may not be possible to make the developing roller 5 stably come into press contact with the photosensitive drum 3. In this case, the developing roller 5 is easily deviated from the photosensitive drum 3, so that it is not possible to smoothly supply toner to the photosensitive drum 3 from the developing roller 5.

Referring to FIG. 4, if the entire shape of each of the guide grooves 27 is the shape of a straight line extending along the first portion 27A, the first portion 27A may extend in a direction (second inclination direction Y) close to the above-mentioned predetermined direction (front-back direction). Therefore, each of the guide grooves 27 may be long in the front-back direction. In accordance with this, the size of the side plate 22, on which the respective guide grooves 27 are formed, may be increased in the front-back direction. Accordingly, it may be difficult to reduce the size of the process unit 20.

In the above-described embodiment, each of the guide grooves 27 includes the second portion 27B extending in the direction (first inclination direction X) intersecting the first portion 27A, from the opening 74 formed on the upstream side in the mounting direction, toward the downstream side in the mounting direction. Accordingly, the entire shape of each of the guide grooves 27 is a substantially L shape which is bent partway when viewed from the right side. Accordingly, even though the first portion 27A extends in a direction close to the front-back direction, the entire guide groove 27 becomes short in the front-back direction due to the bend of the groove. Accordingly, it may be possible to reduce the size of the side plate 22 (that is, the process unit 20) in the front-back direction. That is, it may be possible to reduce the size of the process unit 20 having the structure where the developing cartridges 6 are mounted in the drawer unit 21 so as to be provided in parallel.

As shown in FIG. 5B, the developing casing 50 of each of the developing cartridges 6 includes the first casing portion 50A which supports the developing roller 5 and the supply roller 52, and the second casing portion 50B which stores toner. The second casing portion 50B is provided with the upper front wall 55C. The upper front wall 55C is connected to the lower front wall 55B, which opposes the developing roller 5 and the supply roller 52 at the first casing portion 50A, through the first stepped portion 55A. The upper front wall 55C is positioned at an inner portion of the developing casing 50 in comparison with the lower front wall 55B. That is, at the developing easing 50, a protrusion (the first stepped portion 55A and the lower front wall 55B) protruding to the outside of the casing (front lower side) is formed by the first stepped portion 55A and the lower front wall 55B, and a recessed portion (recess 75), which extends toward the inside of the casing (the rear upper side), is formed by the upper front wall 55C.

Meanwhile, each of the beam members 38 of the drawer unit 21 includes the lower rear wall 38D and the upper rear wall 38E. In a state where the corresponding developing cartridge 6 (which is adjacent to the beam member 38 from the rear side) is mounted in the drawer unit 21, the lower rear wall 38D opposes the lower front wall 55B of the developing cartridge 6 with the first distance T therebetween. The upper rear wall 38E is connected to the lower rear wall 38D through the second stepped portion 38F interposed between, further protrudes toward the developing cartridge 6 in comparison with the lower rear wall 38D. The upper rear wall 38E opposes the upper front wall 55C of the developing cartridge 6 with the second distance U (which may be substantially equal to the second distance T) therebetween. That is, in each of the beam members 38, a recessed portion (the recess 39), which extends toward the inside of the beam member 38 (front lower side), is formed by the lower rear wall 38D, and a protrusion (the second stepped portion 38F and the upper rear wall 38E), which protrudes toward the outside of the beam member 38 (the corresponding developing cartridge 6, the rear upper side) is formed by the second stepped portion 38F and the upper rear wall 38E.

In a state where the corresponding developing cartridge 6 is mounted in the drawer unit 21, the lower rear wall 38D of the beam member 38 opposes the lower front wall 55B of the developing cartridge 6, and the upper rear wall 38E of the beam member 38 opposes the upper front wall 55C of the developing cartridge 6. Accordingly, the protrusion of the above-mentioned developing cartridge 6 is fitted to the recessed portion (recess 39) of the beam member 38, and the protrusion of the beam member 38 is fitted to the recessed portion (recess 75) of the developing cartridge 6. Further, the first distance T between the lower front wall 55B and the lower rear wall 38D may be substantially equal to the opposite distance U between the upper front wall 55C and the upper rear wall 38E. As a result, it may be possible to compactly dispose the adjacent beam members 38 and developing cartridges 6 in the process unit 20. Therefore, it may be possible to further reduce the size of the process unit 20 having the structure where the developing cartridges 6 are mounted in the drawer unit 21 so as to be provided in parallel.

Further, the recess 75 may be formed at the developing cartridge 6 by disposing the upper front wall 55C at an inner portion of the developing casing 50 in comparison with the lower front wall 55B as described above, and the recess 75 may be used as a space where the upper rear wall 38E (specifically, the flow passage 45) of the beam member 38 is fit.

(2) Referring to the developing cartridge 6M of FIGS. 5A and 5B, when the developing roller 5 reaches the first portion 27A in the mounting direction (see FIG. 4), and the developing cartridge 6 is rotated about the developing roller 5, the lower rear wall 38D of the corresponding beam member 38 (which is adjacent to the developing cartridge 6 from the front side) opposes the lower front wall 55B with the first distance T therebetween and the upper rear wall 38E thereof opposes the upper front wall 55C with the second distance U therebetween as shown in FIG. 5B.

As described above, at the developing casing 50 of the developing cartridge 6, the protrusion is formed by the first stepped portion 55A and the lower front wall 55B, and the recessed portion (recess 75) is formed by the upper front wall 55C. Additionally, at the corresponding beam member 38, the recessed portion (recess 39) is formed by the lower rear wall 38D and the protrusion is formed by the second stepped portion 38F and the upper rear wall 38E. Here, when the developing cartridge 6 is rotated, the protrusion of the developing cartridge 6 may be smoothly fitted to the recessed portion (recess 39) of the beam member 38 and the protrusion of the beam member 38 may be smoothly fitted to the recessed portion (recess 75) of the developing cartridge 6.

(3) In the state where the developing cartridge 6 is mounted in the drawer unit 21 as shown in FIG. 8, the developing cartridge 6 is movable by only a third distance in the extending direction of the first portion 27A (in the second inclination direction Y shown in FIG. 4) between the contact position (see the developing cartridge 6K) where the developing roller 5 comes into contact with the corresponding photosensitive dram 3 and the separation position (see the developing cartridges 6Y, 6M, and 6C) where the developing roller 5 is separated from the photosensitive drum 3.

When the developing cartridge 6 is in the contact position, the lower rear wall 38D of the corresponding beam member 38 (which is adjacent to the developing cartridge 6 from the front side) opposes the lower front wall 55B with the first distance T therebetween and the upper rear wall 38E thereof opposes the upper front wall 55C with the second distance U therebetween as shown in FIG. 5B. Further, the gap Z is maintained between the first stepped portion 55A and the second stepped portion 38F in the extending direction of the first portion 27A of the guide groove 27 (the second inclination direction Y shown in FIG. 4). That is, when the above-mentioned protrusion of the developing cartridge 6 is fitted to the recessed portion (recess 39) of the beam member 38 and the above-mentioned protrusion of the beam member 38 is fitted to the recessed portion (recess 75) of the developing cartridge 6, the protrusions of the developing cartridge 6 and the beam member 38 are loosely fitted to the corresponding recessed portions (recesses 39 and 75), respectively, so that the positions of the protrusions can be changed in the extending direction of the first portion 27A.

Further, even though the developing cartridge 6 is moved from the contact position to the separation position (see the developing cartridges 6Y, 6M, and 6C in FIG. 8), the lower rear wall 38D of the corresponding beam member 38 opposes the lower front wall 55B with the first distance T therebetween, and the upper rear wall 38E thereof opposes the upper front wall 55C with the second distance U therebetween. Moreover, the gap Z is maintained between the first stepped portion 55A and the second stepped portion 38F in the extending direction of the first portion 27A (see also FIG. 8). That is, even though the developing cartridge 6 is moved to the separation position from the contact position, the above-mentioned protrusion of the developing cartridge 6 can remain loosely fitted to the recessed portion (recess 39) of the beam member 38 and the above-mentioned protrusion of the beam member 38 can remain loosely fitted to the recessed portion (recess 75) of the developing cartridge 6.

Accordingly, no matter what position the developing cartridge 6 is in between the contact position and the separation position, the protrusion of the developing cartridge 6 is fitted to the recessed portion (recess 39) of the beam member 38 and the protrusion of the beam member 38 is fitted to the recessed portion (recess 75) of the developing cartridge 6. Accordingly, it may be possible to maintain a state where the adjacent beam members 38 and developing cartridges 6 are compactly provided. In other words, the protrusion of the developing cartridge 6 is fitted to the recessed portion (recess 39) of the beam member 38 and the protrusion of the beam member 38 is fitted to the recessed portion (recess 75) of the developing cartridge 6. Therefore, it may be possible to move the developing cartridge 6 between the contact position and the separation position while the adjacent beam members 38 and developing cartridges 6 are compactly provided. Further, since the recesses 39 and 75 have been already formed, it is not necessary to separately form a space required for the movement of the developing cartridge 6 between the contact position and the separation position.

(4) The process unit 20 includes the cleaning rollers 42 which are provided so as to oppose the corresponding photosensitive drums 3 and clean foreign materials from the photosensitive drums 3.

The cleaning roller 42 is held by the first portion 38G which corresponds to the lower rear wall 38D of the corresponding beam member 38, and the charger 4 is held, by the second portion 38H which corresponds to the upper rear wall 38E of the corresponding beam member 38. The upper rear wall 38E further protrudes toward the developing cartridge 6 (rear upper side) in comparison with the lower rear wall 38D. Accordingly, the volume of the second portion 38H, which corresponds to the upper rear wall 38E of the beam member 38, is larger than the volume of the first portion 38G (here, this means only a portion where the cleaning roller 42 is provided) which corresponds to the lower rear wall 38D (thick toward the rear upper side).

Further, the charger 4, which requires a relatively large space in order to stably perform electric discharge, is held by the second portion 38H, which has a relatively large volume, of the beam member 38. In general, the cleaning roller 42 does not require accuracy as much as the developing roller 5 in terms of the pressing force which is uniformly applied to the photosensitive drum 3 in the longitudinal direction. The cleaning roller is formed of a soft elastic layer such as a sponge which can reliably come into contact with the peripheral surface of the photosensitive drum 3. Since the cleaning roller has only to come into press contact with the photosensitive drum 3 clue to a weak force, the elastic layer may be thinned. Further, since the stiffness required for the rotating shaft of the cleaning roller 42 may be low for the same reason, the diameter of the rotating shaft may be reduced. As a result, the diameter of the cleaning roller 42 may be reduced. Accordingly, the space required to dispose the cleaning roller 42 may be smaller than the space required to dispose the charger 4, and the cleaning roller 42 is held by the first portion 38G of which the volume is smaller than the volume of the second portion 38H. Therefore, it may be possible to optimally dispose the charger 4 and the cleaning roller 42 in the beam member 38.

(5) Since the flow passage 45 through which air flows so as to pass through the charger 4 is formed at the second portion 38H, it may be possible to ventilate the surroundings of the charger 4 by the flow passage 45 and to prevent the deterioration of the charger 4. Here, the deterioration of the charger 4 may be as follows: air containing silica stays around the discharge wire 40 (see the foremost charger 4 shown in FIG. 5B), so that silica adheres to the discharge wire 40.

(6) Further, as shown in FIG. 1, the process unit 20 includes a frame (drawer unit 21), the photosensitive drums 3 which is supported by the drawer unit 21 so as to be provided in parallel and on which electrostatic latent images are formed, and the developing cartridges 6 which include developing rollers 5 and are detachably mounted in the drawer unit 21. The developing rollers 5 develop the electrostatic latent images by supplying developer (toner) to the corresponding photosensitive drums 3. As shown in FIG. 2, the drawer unit 21 includes a pair of side parts (side plates 22). The side parts are provided on both sides of each of the photosensitive drums 3 in the longitudinal direction (width direction), and the photosensitive drums 3 is rotatably supported by the side parts. The opening 74, through which each of the developing cartridges 6 to be detachably mounted in the drawer unit 21, is formed at the drawer unit 21 on the opposite side of the photosensitive drums 3 in the up-down direction.

The guide grooves 27 are formed on each of the side plates 22. As shown in FIG. 4, the guide groove 27 extends from the opening 74 toward the downstream side in the mounting direction, and guides the developing roller 5 of each of the developing cartridges 6 to be mounted in the drawer unit 21 to the photosensitive drum 3. Each of the guide grooves 27 includes at least first and second portions 27A and 27B. The first portion 27A is provided at the downstream end in the mounting direction and extends toward the rotation center 3A of the photosensitive drum 3 as directing to the downstream side in the mounting direction. The second portion 27B is provided at the upstream side in the mounting direction and extends from the opening 74 in a direction intersecting the first portion 27A, toward the downstream side in the mounting direction.

According to the above-described configuration, the developing roller 5 stably presses the photosensitive drum 3, and the developing cartridges 6 may be provided in parallel in the horizontal direction in a limited space of the drawer unit 21 without interfering with the adjacent developing cartridges 6 (see FIG. 1).

4. Modification

While the present invention has been shown and described with reference to certain exemplary embodiments thereof, it will be understood by those skilled in the art that various changes in form and details may be made therein without departing from the spirit and scope of the invention as defined by the appended claims.

For example, in the printer 1, the photosensitive drums 3 are exposed to the laser generated by the scanner unit 7 as shown in FIG. 1. However, an LED may be used for the exposure of the photosensitive drums 3 instead of the scanner unit 7.

What is claimed is:

1. A photosensitive unit comprising:

a frame;

a plurality of photosensitive drums which are held by the frame to be in parallel with each other and arranged in a predetermined direction, and on which electrostatic latent images are to be formed, respectively;

a plurality of chargers which are provided so as to oppose the photosensitive drums, respectively, and configured to charge the photosensitive drums, respectively;

a plurality of cleaning members which are provided to oppose the photosensitive drums, respectively, and configured to clean the photosensitive drums, respectively; and a plurality of cartridges which are detachably mounted in the frame, each of the cartridges including:

a developing roller configured to develop an electrostatic latent image formed on a corresponding photosensitive drum by supplying developer thereto, a supply roller configured to supply developer to the developing roller, and a casing including:

a first casing portion configured to rotatably support the developing roller and the supply roller, and including a first wall opposing the developing roller and the supply roller;

a second casing portion configured to store developer, and including a second wall and an agitator configured to agitate the developer; and a first stepped portion which connects the first casing portion and the second casing portion such that the first wall and the first stepped portion protrude to a side opposite to a rotating shaft of the agitator with respect to an extension line of the second wall, wherein the frame includes:

a pair of side parts including a first side part and a second side part, the first side part and the second side part being provided on both sides of the photosensitive drums in a longitudinal direction of the photosensitive drums, and configured to rotatably support the photosensitive drums;

a plurality of beam members which are provided between the first and second side parts and provided for the plurality of cartridges, respectively; and an opening formed at an opposite side of the photosensitive drums in a direction orthogonal to the predetermined direction and the longitudinal direction, and through which the cartridges are to be detachably mounted in the frame, wherein each of the first and second side parts of the frame includes a plurality of guide grooves, each of which extends from the opening toward a downstream side in a mounting direction, along which the cartridge is mounted in the frame, each of the guide grooves being configured to guide the developing roller of the cartridge to be mounted, toward the corresponding photosensitive drum, wherein each of the guide grooves includes at least:

a first portion which is provided at a downstream end in the mounting direction and extends toward a rotation center of the corresponding photosensitive drum as directing to the downstream side in the mounting direction; and a second portion which is provided at an upstream side in the mounting direction and extends from the opening in a direction intersecting an extending direction of the first portion, toward the downstream side in the mounting direction, wherein each of the beam members includes:

a third wall covering a corresponding cleaning member, wherein, in a state where an adjacent cartridge is mounted in the frame, the third wall and the first wall of the adjacent cartridge face and are exposed to each other;

a fourth wall covering a corresponding charger, wherein, in the state where the adjacent cartridge is mounted in the frame, the fourth wall and the second wall of the adjacent cartridge face and are exposed to each other, wherein a projected imaginary plane of the third wall intersects the corresponding charger; and a second stepped portion which connects the third wall and the fourth wall such that, in the state where the adjacent cartridge is mounted in the frame, the first wall of the adjacent cartridge is located between the third wall and a projected imaginary plane extending from the fourth wall in a range where the third wall extends, and wherein each of the cartridges includes a pivot shaft configured such that:

in the state where the adjacent cartridge is mounted in the frame, the cartridge is pivotable between a first position and a second position with respect to a corresponding photosensitive drum;

when the cartridge is in the first position, the first wall thereof and the third wall of an adjacent beam member face and are exposed to each other with a first distance therebetween, and the second wall thereof and the fourth wall of the adjacent beam member face and are exposed to each other with a second distance therebetween; and when the cartridge is in the second position, the first wall thereof and the third wall of the adjacent beam member face and are exposed to each other with a distance greater than the first distance therebetween, and the second wall thereof and the fourth wall of the adjacent beam member face and are exposed to each other with a distance greater than the second distance therebetween.

2. The photosensitive unit according to claim 1, wherein each of the guide grooves on the first side part is aligned with a corresponding one of the guide grooves on the second side part in the longitudinal direction, and wherein, in a state where each of the cartridges is mounted in the frame, the first wall of the cartridge is arranged substantially in parallel with a reference plane connecting the first portion of each of the guide grooves of the first side part and the first portion of the corresponding one of the guide grooves of the second side part.

3. The photosensitive unit according to claim 1, wherein in each of the cartridges being rotated about the developing roller at the first portion, the first wall faces the third wall of the corresponding beam member with the first distance, and the second wall faces the fourth wall of the corresponding beam member with the second distance.

4. The photosensitive unit according to claim 3, wherein each of the cartridges is rotated while the developing roller contacts the corresponding photosensitive drum.

5. The photosensitive unit according to claim 1, wherein, in a state where each of the cartridges is mounted in the frame, the cartridge is movable in the extending direction of the first portion of a corresponding guide groove between a contact position where the developing roller is in contact with the corresponding photosensitive drum and a separation position where the developing roller is separated from the corresponding photosensitive drum, wherein in the state where the cartridge is in the contact position, the first wall faces the third wall of an adjacent beam member with the first distance therebetween, the second wall faces the fourth wall of the adjacent beam member with the second distance therebetween, and a gap is formed between the first and second stepped portions in the extending direction of the first portion of the corresponding guide groove, and wherein during movement of the cartridge from the contact position to the separation position, the first wall faces the third wall of the adjacent beam member with the first distance therebetween, the second wall faces the fourth wall of the adjacent beam member with the second distance therebetween, and the gap is maintained between the first and second stepped portions in the extending direction of the first portion.

6. The photosensitive unit according to claim 1, wherein each of the beam members includes, between the fourth wall and the corresponding charger, a flow passage through which air flows, so as to pass through the corresponding charger.

7. The photosensitive unit according to claim 1, wherein each of the chargers and each of the cleaning members are provided between adjacent photosensitive drums.

8. An image forming apparatus comprising: a scanner unit; and a photosensitive unit according to claim 1.

9. The photosensitive unit according to claim 1, wherein, when at least one of the plurality of cartridges is mounted in the frame, a projected imaginary plane of the fourth wall of an adjacent beam member intersects the first casing portion of the at least one of the plurality of cartridges.

10. The photosensitive unit according to claim 1, wherein, when at least one of the cartridges pivots from the second position to the first position, the first wall is located between the third wall and the projected imaginary plane extending from the fourth wall.

11. The photosensitive unit according to claim 10, wherein each of the cartridges is configured to, when each of cartridges is mounted in the frame, pivot between the first position and the second position while the developing roller maintains contact with the corresponding photosensitive drum.

12. The photosensitive unit according to claim 1, wherein, when the cartridge is in the first position, the first distance between the first wall thereof and the third wall of the adjacent beam member is smaller than a distance by which the fourth wall of the adjacent beam member protrudes with respect to the third wall.

13. The photosensitive unit according to claim 1, wherein an imaginary line perpendicular to and intersecting the third wall further intersects the first wall of the adjacent cartridge at a point disposed between the third wall and the projected imaginary plane extending from the fourth wall.

* * * * *

UNITED STATES PATENT AND TRADEMARK OFFICE

CERTIFICATE OF CORRECTION

PATENT NO. : 8,831,473 B2
APPLICATION NO. : 12/626324
DATED : September 9, 2014
INVENTOR(S) : Junichi Hashimoto et al.

It is certified that error appears in the above-identified patent and that said Letters Patent is hereby corrected as shown below:

On the title page item 73, under Assignee:

Please delete "Brothter Kogyo Kabushiki Kaisha" and replace with --Brother Kogyo Kabushiki Kaisha--

Signed and Sealed this
Twenty-sixth Day of April, 2016

Michelle K. Lee

Michelle K. Lee
*Director of the United States Patent and Trademark Office*